US007916163B2

(12) United States Patent
Koizumi et al.

(10) Patent No.: US 7,916,163 B2
(45) Date of Patent: Mar. 29, 2011

(54) EXPOSURE HEAD, A METHOD OF CONTROLLING AN EXPOSURE HEAD AND AN IMAGE FORMING APPARATUS

(75) Inventors: Ryuta Koizumi, Shiojiri (JP); Nozomu Inoue, Matsumoto (JP); Yujiro Nomura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 24 days.

(21) Appl. No.: 12/334,312

(22) Filed: Dec. 12, 2008

(65) Prior Publication Data

US 2009/0153642 A1 Jun. 18, 2009

(30) Foreign Application Priority Data

Dec. 14, 2007 (JP) ..... 2007-323664
Oct. 6, 2008 (JP) ..... 2008-259370

(51) Int. Cl.
*B41J 2/45* (2006.01)

(52) U.S. Cl. ..... 347/238

(58) Field of Classification Search ..... 347/133, 347/236–238, 246, 247, 241, 244, 256, 258
See application file for complete search history.

(56) References Cited

U.S. PATENT DOCUMENTS

| | | | | |
|---|---|---|---|---|
| 6,069,741 | A * | 5/2000 | Osawa | 359/621 |
| 6,989,849 | B2 | 1/2006 | Nomura et al. | |
| 2004/0125196 | A1 | 7/2004 | Nomura et al. | |
| 2006/0092519 | A1 | 5/2006 | Hasei | |
| 2009/0251675 | A1 * | 10/2009 | Masumoto et al. | 355/69 |

FOREIGN PATENT DOCUMENTS

| | | | |
|---|---|---|---|
| EP | 138887 | A1 | 2/2004 |
| JP | 02-004546 | | 1/1990 |
| JP | 11048526 | A | 2/1999 |
| JP | 2007019384 | A | 1/2007 |

OTHER PUBLICATIONS

European search report for corresponding European application 08021619.5-1251 lists the references above.

* cited by examiner

*Primary Examiner* — Hai C Pham
(74) *Attorney, Agent, or Firm* — DLA Piper LLP (US)

(57) ABSTRACT

An exposure head, includes: an imaging optical system; a first light emitting element that emits a light which is to be focused by the imaging optical system; a second light emitting element that emits a light which is to be focused by the imaging optical system; a first TFT circuit that is connected with the first light emitting element via an interconnection wire; and a second TFT circuit that is connected with the second light emitting element via an interconnection wire, wherein the first light emitting element and the second light emitting element are provided between the first TFT circuit and the second TFT circuit.

12 Claims, 23 Drawing Sheets

EXPOSURE HEAD, A METHOD OF CONTROLLING AN EXPOSURE HEAD AND AN IMAGE FORMING APPARATUS

CROSS REFERENCE TO RELATED APPLICATION

The disclosure of Japanese Patent Applications No. 2007-323664 filed on Dec. 14, 2007 and No. 2008-259370 filed on Oct. 6, 2008 including specification, drawings and claims is incorporated herein by reference in its entirety.

BACKGROUND

1. Technical Field

The invention relates to an exposure head for imaging light beams emitted from light emitting elements by imaging optical systems, a control method of the exposure head and an image forming apparatus using the exposure head.

2. Related Art

Known as such an exposure head is one as that described in JP-A-2-4546 for instance in which a plurality of light emitting elements such as LEDs (light emitting diodes) are arranged on a substrate. Driving of these light emitting elements can be controlled by a circuit which is formed by a thin film transistor which is known as a "TFT (thin film transistors)". That is, driven by TFT circuits, light emitting elements emit light beams. Light beams emitted from the light emitting elements in this way are imaged by a lens and the surface of a latent image carrier such as a photosensitive member is exposed.

SUMMARY

By the way, in the line head described above, the light emitting elements and the TFT circuits are connected by interconnection wires to each other for the purpose of supplying the light emitting elements a signal from the TFT circuits. However, inappropriate arrangement of the TFT circuits sometimes makes it necessary to lead all interconnection wires connected with the light emitting elements out to the same side, in which case the freedom of installing interconnection wires decreases.

An advantage of some aspects of the invention is to provide a technique for improving the freedom of installing interconnection wires which are connected with light emitting elements.

According to a first aspect of the invention, there is provided an exposure head, comprising: an imaging optical system; a first light emitting element that emits a light which is to be focused by the imaging optical system; a second light emitting element that emits a light which is to be focused by the imaging optical system; a first TFT circuit that is connected with the first light emitting element via an interconnection wire; and a second TFT circuit that is connected with the second light emitting element via an interconnection wire, wherein the first light emitting element and the second light emitting element are provided between the first TFT circuit and the second TFT circuit.

According to a second aspect of the invention, there is provided a method of controlling an exposure head, comprising: exposing a surface-to-be-exposed by means of an exposure head which includes an imaging optical system, a first light emitting element that emits a light which is to be focused on the surface-to-be-exposed by the imaging optical system, a second light emitting element that emits a light which is to be focused on the surface-to-be-exposed by the imaging optical system, a first TFT circuit that is connected with the first light emitting element via an interconnection wire and a second TFT circuit that is connected with the second light emitting element via an interconnection wire, and in which the first light emitting element and the second light emitting element are provided between the first TFT circuit and the second TFT circuit.

According to a third aspect of the invention, there is provided an image forming apparatus, comprising: a latent image carrier; and an exposure head which includes an imaging optical system, a first light emitting element that emits a light which is to be focused on the latent image carrier by the imaging optical system, a second light emitting element that emits a light which is to be focused on the latent image carrier by the imaging optical system, a first TFT circuit that is connected with the first light emitting element via an interconnection wire and a second TFT circuit that is connected with the second light emitting element via an interconnection wire, and in which the first light emitting element and the second light emitting element are provided between the first TFT circuit and the second TFT circuit.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DESCRIPTION OF EXEMPLARY EMBODIMENTS

A. Description of Terms

Terms used in this specification are described before the description of embodiments of the invention.

Figure 1:
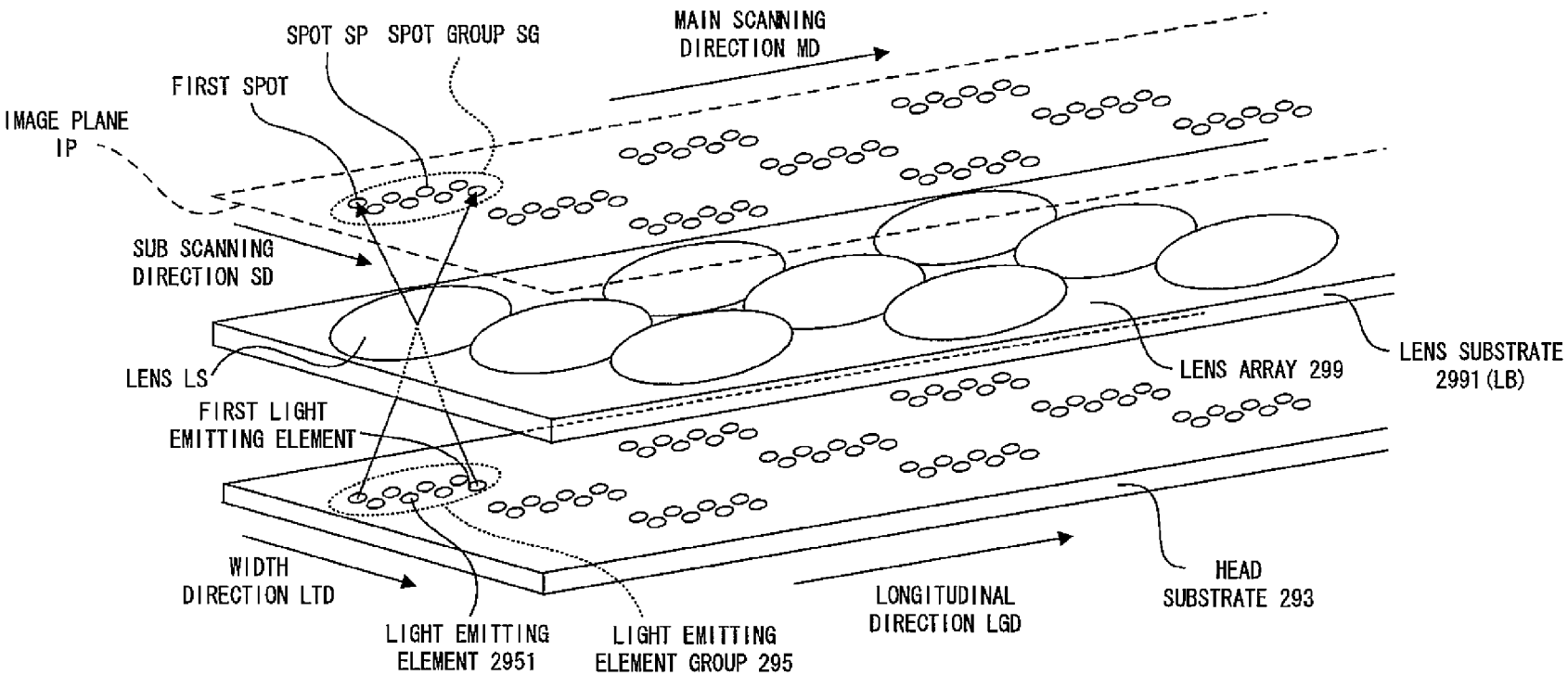
FIGS. 1 and 2 are diagrams showing terminology used in this specification.
Figure 2:
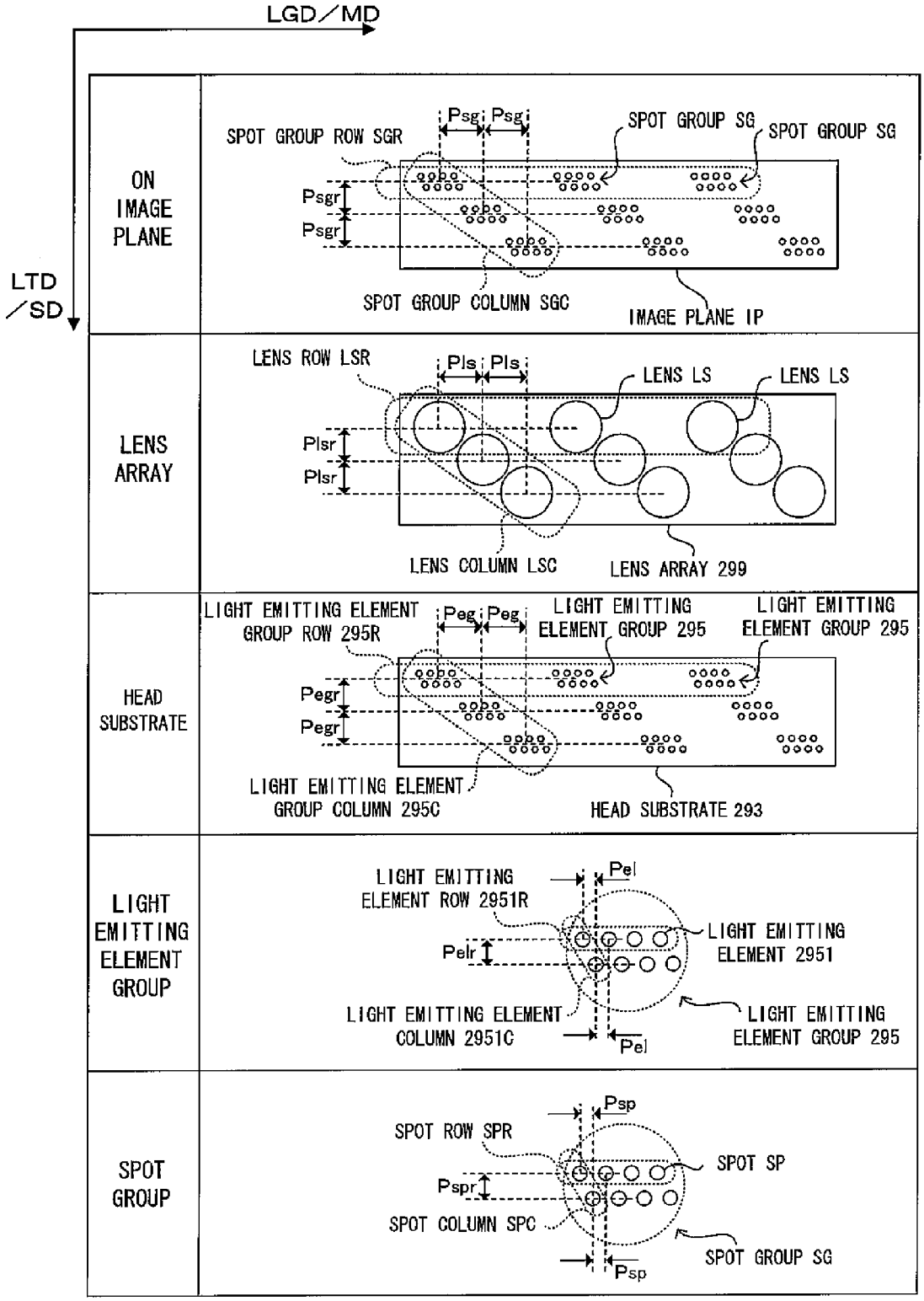

FIGS. 1 and 2 are diagrams showing terminology used in this specification. Here, terminology used in this specification is organized with reference to FIGS. 1 and 2. In this specification, a conveying direction of a surface (image plane IP) of a photosensitive drum 21 is defined to be a sub scanning direction SD and a direction orthogonal to or substantially orthogonal to the sub scanning direction SD is defined to be a main scanning direction MD. Further, a line head 29 is arranged relative to the surface (image plane IP) of the photosensitive drum 21 such that its longitudinal direction LGD corresponds to the main scanning direction MD and its width direction LTD corresponds to the sub scanning direction SD.

Collections of a plurality of (eight in FIGS. 1 and 2) light emitting elements 2951 arranged on a head substrate 293 in one-to-one correspondence with a plurality of lenses LS of a lens array 299 are defined to be light emitting element groups 295. In other words, in the head substrate 293, the plurality of light emitting element groups 295 including the plurality of light emitting elements 2951 are arranged in conformity with the plurality of lenses LS, respectively. Further, collections of a plurality of spots SP formed on the image plane IP by imaging light beams from the light emitting element groups 295 toward the image plane IP by the lenses LS corresponding to the light emitting element groups 295 are defined to be spot groups SG. In other words, a plurality of spot groups SG can be formed in one-to-one correspondence with the plurality of light emitting element groups 295. In each spot group SG, the most upstream spot in the main scanning direction MD and the sub scanning direction SD is particularly defined to be a first spot. The light emitting element 2951 corresponding to the first spot is particularly defined to be a first light emitting element.

A spot group row SGR and a spot group column SGC are defined as shown in the column "On Image Plane" of FIG. 2. Specifically, a plurality of spot groups SG arranged in the main scanning direction MD are defined as the spot group row SGR. A plurality of spot group rows SGR are arranged at specified spot group row pitches Psgr in the sub scanning direction SD. Further, a plurality of (three in FIG. 2) spot groups SG arranged at spot group row pitches Psgr in the sub scanning direction SD and at spot group pitches Psg in the main scanning direction MD are defined as the spot group column SGC. The spot group row pitch Psgr is a distance in the sub scanning direction SD between the geometric centers of gravity of two spot group rows SGR adjacent in the sub scanning direction SD, and the spot group pitch Psg is a distance in the main scanning direction MD between the geometric centers of gravity of two spot groups SG adjacent in the main scanning direction MD.

Lens rows LSR and lens columns LSC are defined as shown in the column of "Lens Array" of FIG. 2. Specifically, a plurality of lenses LS aligned in the longitudinal direction LGD is defined to be the lens row LSR. A plurality of lens rows LSR are arranged at specified lens row pitches Plsr in the width direction LTD. Further, a plurality of (three in FIG. 2) lenses LS arranged at the lens row pitches Plsr in the width direction LTD and at lens pitches Pls in the longitudinal direction LGD are defined to be the lens column LSC. It should be noted that the lens row pitch Plsr is a distance in the width direction LTD between the geometric centers of gravity of two lens rows LSR adjacent in the width direction LTD, and that the lens pitch Pls is a distance in the longitudinal direction LGD between the geometric centers of gravity of two lenses LS adjacent in the longitudinal direction LGD.

Light emitting element group rows 295R and light emitting element group columns 295C are defined as in the column "Head Substrate" of FIG. 2. Specifically, a plurality of light emitting element groups 295 aligned in the longitudinal direction LGD is defined to be the light emitting element group row 295R. A plurality of light emitting element group rows 295R are arranged at specified light emitting element group row pitches Pegr in the width direction LTD. Further, a plurality of (three in FIG. 2) light emitting element groups 295 arranged at the light emitting element group row pitches Pegr in the width direction LTD and at light emitting element group pitches Peg in the longitudinal direction LGD are defined to be the light emitting element group column 295C. It should be noted that the light emitting element group row pitch Pegr is a distance in the width direction LTD between the geometric centers of gravity of two light emitting element group rows 295R adjacent in the width direction LTD, and that the light emitting element group pitch Peg is a distance in the longitudinal direction LGD between the geometric centers of gravity of two light emitting element groups 295 adjacent in the longitudinal direction LGD.

Light emitting element rows 2951R and light emitting element columns 2951C are defined as in the column "Light Emitting Element Group" of FIG. 2. Specifically, in each light emitting element group 295, a plurality of light emitting elements 2951 aligned in the longitudinal direction LGD is defined to be the light emitting element row 2951R. A plurality of light emitting element rows 2951R are arranged at specified light emitting element row pitches Pelr in the width direction LTD. Further, a plurality of (two in FIG. 2) light emitting elements 2951 arranged at the light emitting element row pitches Pelr in the width direction LTD and at light emitting element pitches Pel in the longitudinal direction LGD are defined to be the light emitting element column 2951C. It should be noted that the light emitting element row pitch Pelr is a distance in the width direction LTD between the geometric centers of gravity of two light emitting element rows 2951R adjacent in the width direction LTD, and that the light emitting element pitch Pel is a distance in the longitudinal direction LGD between the geometric centers of gravity of two light emitting elements 2951 adjacent in the longitudinal direction LGD.

Spot rows SPR and spot columns SPC are defined as shown in the column "Spot Group" of FIG. 2. Specifically, in each spot group SG, a plurality of spots SP aligned in the longitudinal direction LGD is defined to be the spot row SPR. A plurality of spot rows SPR are arranged at specified spot row pitches Pspr in the width direction LTD. Further, a plurality of (two in FIG. 2) spots arranged at the spot row pitches Pspr in the width direction LTD and at spot pitches Psp in the longitudinal direction LGD are defined to be the spot column SPC. It should be noted that the spot row pitch Pspr is a distance in the sub scanning direction SD between the geometric centers of gravity of two spot rows SPR adjacent in the sub scanning direction SD, and that the spot pitch Psp is a distance in the main scanning direction MD between the geometric centers of gravity of two spots SP adjacent in the main scanning direction MD.

B. First Embodiment

Figure 3:
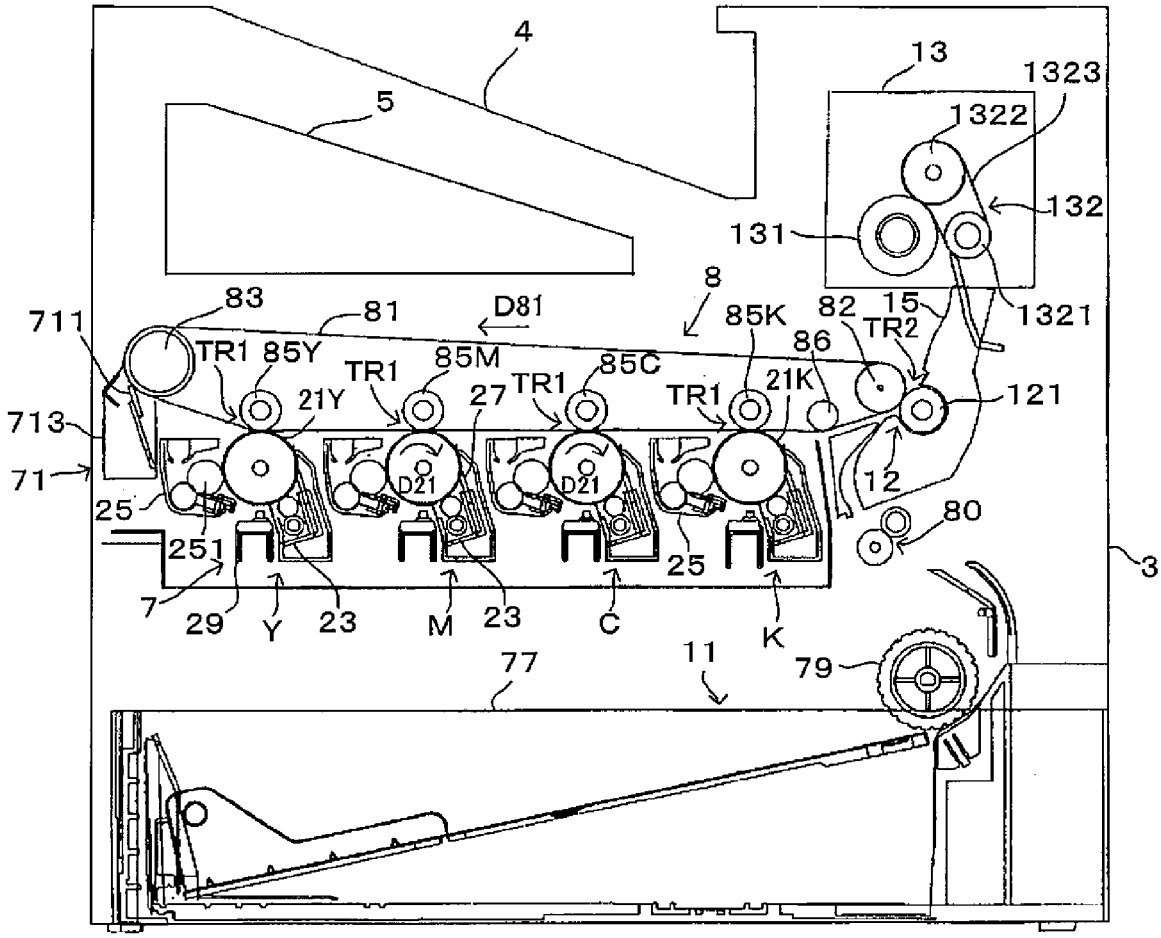
FIG. 3 is a diagram showing an embodiment of an image forming apparatus to which the invention is applicable.
Figure 4:
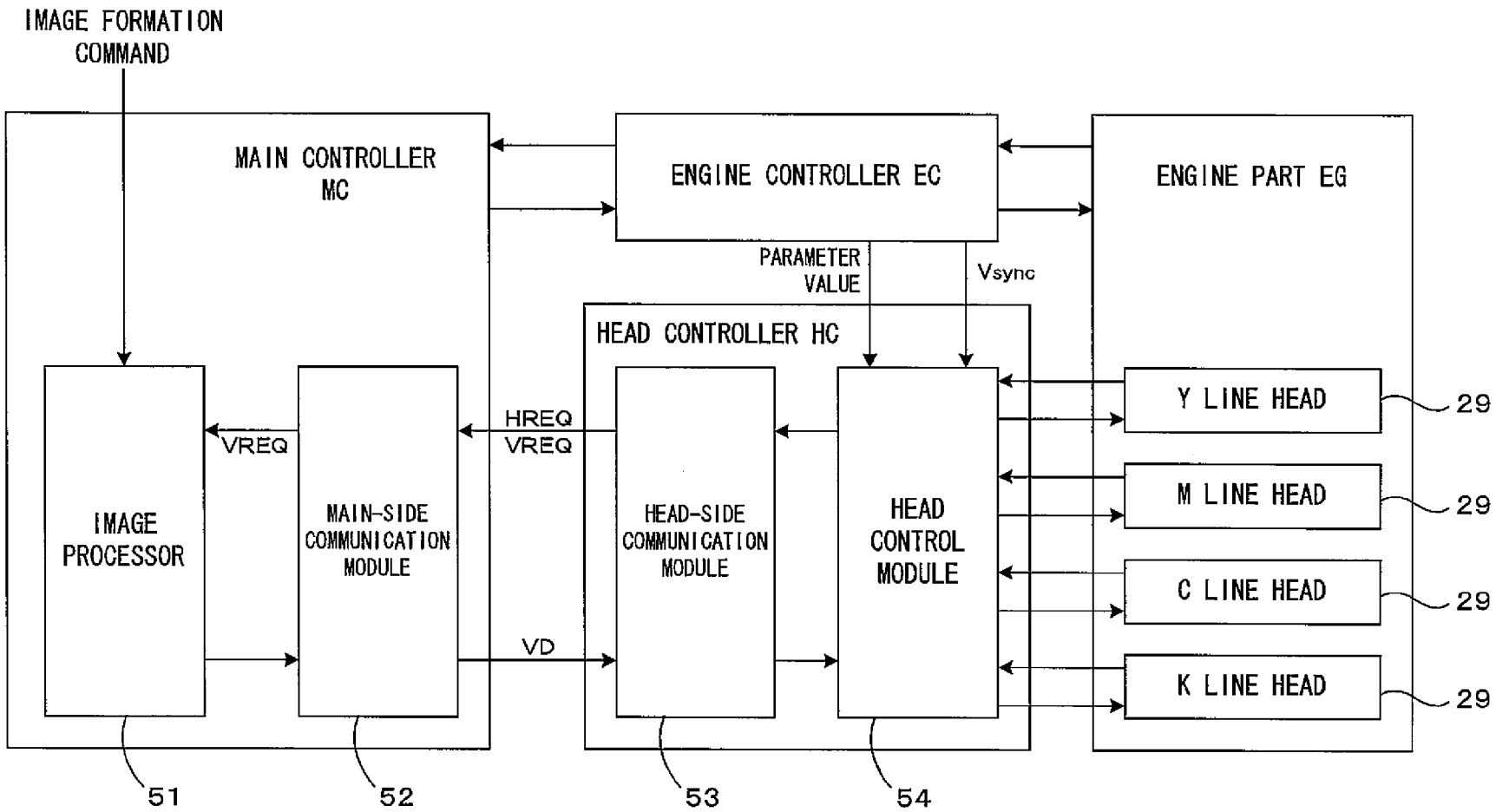
FIG. 4 is a diagram showing the electrical construction of the image forming apparatus of FIG. 3.

FIG. 3 is a diagram showing an embodiment of an image forming apparatus to which the invention is applicable. FIG. 4 is a diagram showing the electrical construction of the image forming apparatus of FIG. 3. This apparatus is an image forming apparatus that can selectively execute a color mode for forming a color image by superimposing four color toners of black (K), cyan (C), magenta (M) and yellow (Y) and a monochromatic mode for forming a monochromatic image using only black (K) toner. FIG. 3 is a diagram corresponding to the execution of the color mode. In this image forming apparatus, when an image formation command is given from an external apparatus such as a host computer to a main controller MC having a CPU and memories, the main controller MC feeds a control signal and the like to an engine controller EC and feeds video data VD corresponding to the image formation command to a head controller HC. This head controller HC controls line heads 29 of the respective colors based on the video data VD from the main controller MC, a vertical synchronization signal Vsync from the engine controller EC and parameter values from the engine controller EC. In this way, an engine part EG performs a specified image forming operation to form an image corresponding to the image formation command on a sheet such as a copy sheet, transfer sheet, form sheet or transparent sheet for OHP.

An electrical component box 5 having a power supply circuit board, the main controller MC, the engine controller EC and the head controller HC built therein is disposed in a housing main body 3 of the image forming apparatus. An image forming unit 7, a transfer belt unit 8 and a sheet feeding unit 11 are also arranged in the housing main body 3. A secondary transfer unit 12, a fixing unit 13 and a sheet guiding member 15 are arranged at the right side in the housing main body 3 in FIG. 3. It should be noted that the sheet feeding unit 11 is detachably mountable into the housing main body 3. The sheet feeding unit 11 and the transfer belt unit 8 are so constructed as to be detachable for repair or exchange respectively.

The image forming unit 7 includes four image forming stations Y (for yellow), M (for magenta), C (for cyan) and K (for black) which form a plurality of images having different colors. Each of the image forming stations Y, M, C and K includes a cylindrical photosensitive drum 21 having a surface of a specified length in a main scanning direction MD. Each of the image forming stations Y, M, C and K forms a toner image of the corresponding color on the surface of the photosensitive drum 21. The photosensitive drum is arranged so that the axial direction thereof is substantially parallel to the main scanning direction MD. Each photosensitive drum 21 is connected to its own driving motor and is driven to rotate at a specified speed in a direction of arrow D21 in FIG. 3, whereby the surface of the photosensitive drum 21 is transported in the sub scanning direction SD which is orthogonal to or substantially orthogonal to the main scanning direction MD. Further, a charger 23, the line head 29, a developer 25 and a photosensitive drum cleaner 27 are arranged in a rotating direction around each photosensitive drum 21. A charging operation, a latent image forming operation and a toner developing operation are performed by these functional sections. Accordingly, a color image is formed by superimposing toner images formed by all the image forming stations Y, M, C and K on a transfer belt 81 of the transfer belt unit 8 at the time of executing the color mode, and a monochromatic image is formed using only a toner image formed by the image forming station K at the time of executing the monochromatic mode. Meanwhile, since the respective image forming stations of the image forming unit 7 are identically constructed, reference characters are given to only some of the image forming stations while being not given to the other image forming stations in order to facilitate the diagrammatic representation in FIG. 3.

The charger 23 includes a charging roller having the surface thereof made of an elastic rubber. This charging roller is constructed to be rotated by being held in contact with the surface of the photosensitive drum 21 at a charging position. As the photosensitive drum 21 rotates, the charging roller is rotated at the same circumferential speed in a direction driven by the photosensitive drum 21. This charging roller is connected to a charging bias generator (not shown) and charges the surface of the photosensitive drum 21 at the charging position where the charger 23 and the photosensitive drum 21 are in contact upon receiving the supply of a charging bias from the charging bias generator.

The line head 29 is arranged relative to the photosensitive drum 21 so that the longitudinal direction thereof corresponds to the main scanning direction MD and the width direction thereof corresponds to the sub scanning direction SD. Hence, the longitudinal direction of the line head 29 is substantially parallel to the main scanning direction MD. The line head 29 includes a plurality of light emitting elements arrayed in the longitudinal direction and is positioned separated from the photosensitive drum 21. Light beams are emitted from these light emitting elements toward the surface of the photosensitive drum 21 charged by the charger 23, thereby forming an electrostatic latent image on this surface.

The developer 25 includes a developing roller 251 carrying toner on the surface thereof. By a development bias applied to the developing roller 251 from a development bias generator (not shown) electrically connected to the developing roller 251, charged toner is transferred from the developing roller 251 to the photosensitive drum 21 to develop the latent image formed by the line head 29 at a development position where the developing roller 251 and the photosensitive drum 21 are in contact.

The toner image developed at the development position in this way is primarily transferred to the transfer belt 81 at a primary transfer position TR1 to be described later where the transfer belt 81 and each photosensitive drum 21 are in contact after being transported in the rotating direction D21 of the photosensitive drum 21.

Further, the photosensitive drum cleaner 27 is disposed in contact with the surface of the photosensitive drum 21 downstream of the primary transfer position TR1 and upstream of the charger 23 with respect to the rotating direction D21 of the photosensitive drum 21. This photosensitive drum cleaner 27 removes the toner remaining on the surface of the photosensitive drum 21 to clean after the primary transfer by being held in contact with the surface of the photosensitive drum.

The transfer belt unit 8 includes a driving roller 82, a driven roller (blade facing roller) 83 arranged to the left of the driving roller 82 in FIG. 3, and the transfer belt 81 mounted on these rollers. The transfer belt unit 8 also includes four primary transfer rollers 85Y, 85M, 85C and 85K arranged to face in a one-to-one relationship with the photosensitive drums 21 of the respective image forming stations Y, M, C and K inside the transfer belt 81 when the photosensitive cartridges are mounted. These primary transfer rollers 85Y, 85M, 85C and 85K are respectively electrically connected to a primary transfer bias generator (not shown). As described in detail later, at the time of executing the color mode, all the primary transfer rollers 85Y, 85M, 85C and 85K are positioned on the sides of the image forming stations Y, M, C and K as shown in FIG. 3, whereby the transfer belt 81 is pressed into contact with the photosensitive drums 21 of the image forming stations Y, M, C and K to form the primary transfer positions TR1 between the respective photosensitive drums 21 and the transfer belt 81. By applying primary transfer biases from the primary transfer bias generator to the primary transfer rollers 85Y, 85M, 85C and 85K at suitable timings, the toner images formed on the surfaces of the respective photosensitive drums 21 are transferred to the surface of the transfer belt 81 at the corresponding primary transfer positions TR1 to form a color image.

On the other hand, out of the four primary transfer rollers 85Y, 85M, 85C and 85K, the color primary transfer rollers 85Y, 85M, 85C are separated from the facing image forming stations Y, M and C and only the monochromatic primary transfer roller 85K is brought into contact with the image forming station K at the time of executing the monochromatic mode, whereby only the monochromatic image forming station K is brought into contact with the transfer belt 81. As a result, the primary transfer position TR1 is formed only between the monochromatic primary transfer roller 85K and the image forming station K. By applying a primary transfer bias at a suitable timing from the primary transfer bias generator to the monochromatic primary transfer roller 85K, the toner image formed on the surface of the photosensitive drum 21 is transferred to the surface of the transfer belt 81 at the primary transfer position TR1 to form a monochromatic image.

The transfer belt unit 8 further includes a downstream guide roller 86 disposed downstream of the monochromatic primary transfer roller 85K and upstream of the driving roller 82. This downstream guide roller 86 is so disposed as to come into contact with the transfer belt 81 on an internal common tangent to the primary transfer roller 85K and the photosensitive drum 21 at the primary transfer position TR1 formed by the contact of the monochromatic primary transfer roller 85K with the photosensitive drum 21 of the image forming station K.

The driving roller 82 drives to rotate the transfer belt 81 in the direction of the arrow D81 and doubles as a backup roller for a secondary transfer roller 121. A rubber layer having a thickness of about 3 mm and a volume resistivity of 1000 kΩ·cm or lower is formed on the circumferential surface of the driving roller 82 and is grounded via a metal shaft, thereby serving as an electrical conductive path for a secondary transfer bias to be supplied from an unillustrated secondary transfer bias generator via the secondary transfer roller 121. By providing the driving roller 82 with the rubber layer having high friction and shock absorption, an impact caused upon the entrance of a sheet into a contact part (secondary transfer position TR2) of the driving roller 82 and the secondary transfer roller 121 is unlikely to be transmitted to the transfer belt 81 and image deterioration can be prevented.

The sheet feeding unit 11 includes a sheet feeding section which has a sheet cassette 77 capable of holding a stack of sheets, and a pickup roller 79 which feeds the sheets one by one from the sheet cassette 77. The sheet fed from the sheet feeding section by the pickup roller 79 is fed to the secondary transfer position TR2 along the sheet guiding member 15 after having a sheet feed timing adjusted by a pair of registration rollers 80.

The secondary transfer roller 121 is provided freely to abut on and move away from the transfer belt 81, and is driven to abut on and move away from the transfer belt 81 by a secondary transfer roller driving mechanism (not shown). The fixing unit 13 includes a heating roller 131 which is freely rotatable and has a heating element such as a halogen heater built therein, and a pressing section 132 which presses this heating roller 131. The sheet having an image secondarily transferred to the front side thereof is guided by the sheet guiding member 15 to a nip portion formed between the heating roller 131 and a pressure belt 1323 of the pressing section 132, and the image is thermally fixed at a specified temperature in this nip portion. The pressing section 132 includes two rollers 1321 and 1322 and the pressure belt 1323 mounted on these rollers. Out of the surface of the pressure belt 1323, a part stretched by the two rollers 1321 and 1322 is pressed against the circumferential surface of the heating roller 131, thereby forming a sufficiently wide nip portion between the heating roller 131 and the pressure belt 1323. The sheet having been subjected to the image fixing operation in this way is transported to the discharge tray 4 provided on the upper surface of the housing main body 3.

Further, a cleaner 71 is disposed facing the blade facing roller 83 in this apparatus. The cleaner 71 includes a cleaner blade 711 and a waste toner box 713. The cleaner blade 711 removes foreign matters such as toner remaining on the transfer belt after the secondary transfer and paper powder by holding the leading end thereof in contact with the blade facing roller 83 via the transfer belt 81. Foreign matters thus removed are collected into the waste toner box 713. Further, the cleaner blade 711 and the waste toner box 713 are constructed integral to the blade facing roller 83. Accordingly, if the blade facing roller 83 moves as described next, the cleaner blade 711 and the waste toner box 713 move together with the blade facing roller 83.

Figure 5:
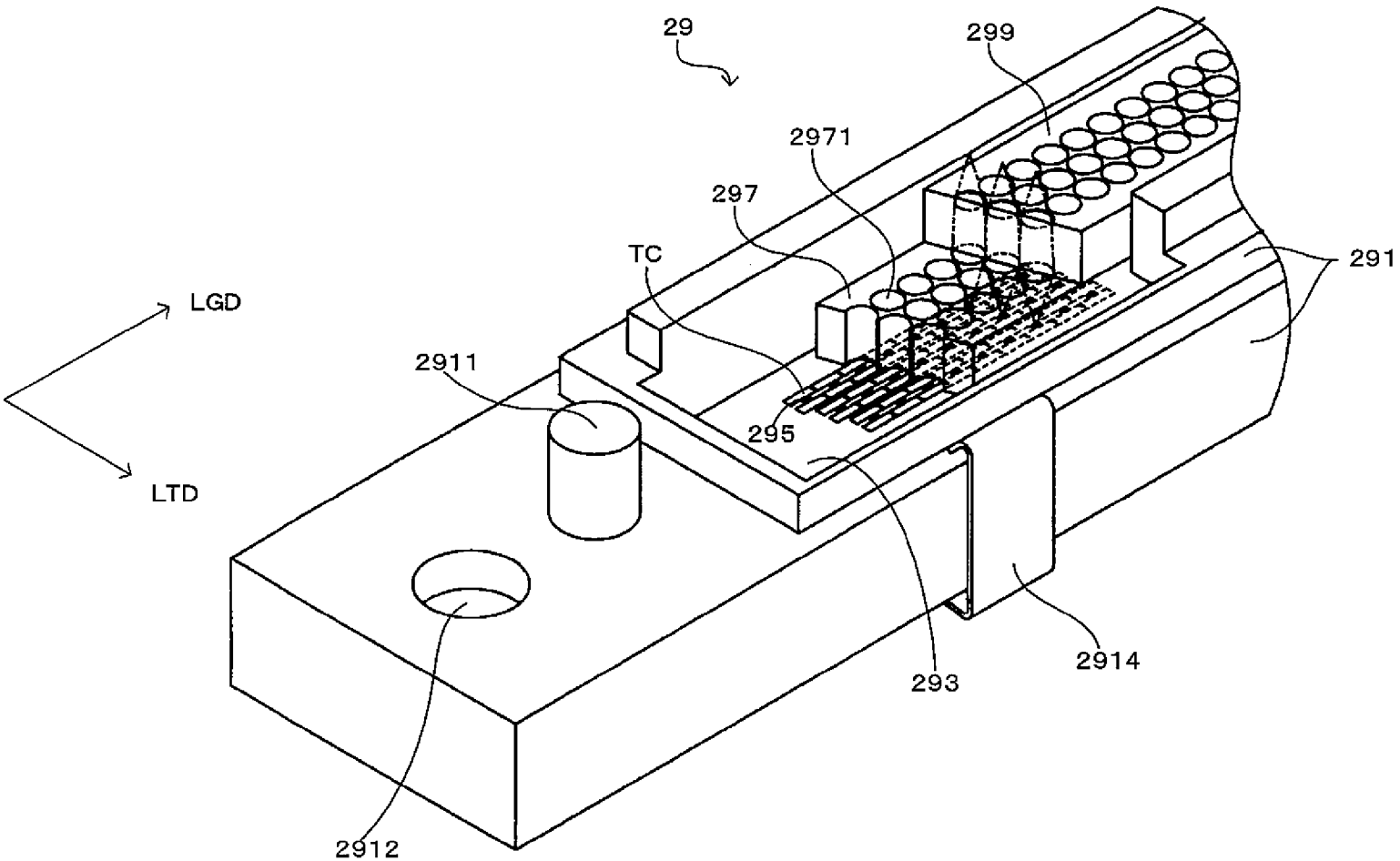
FIG. 5 is a perspective view schematically showing a line head.
Figure 6:
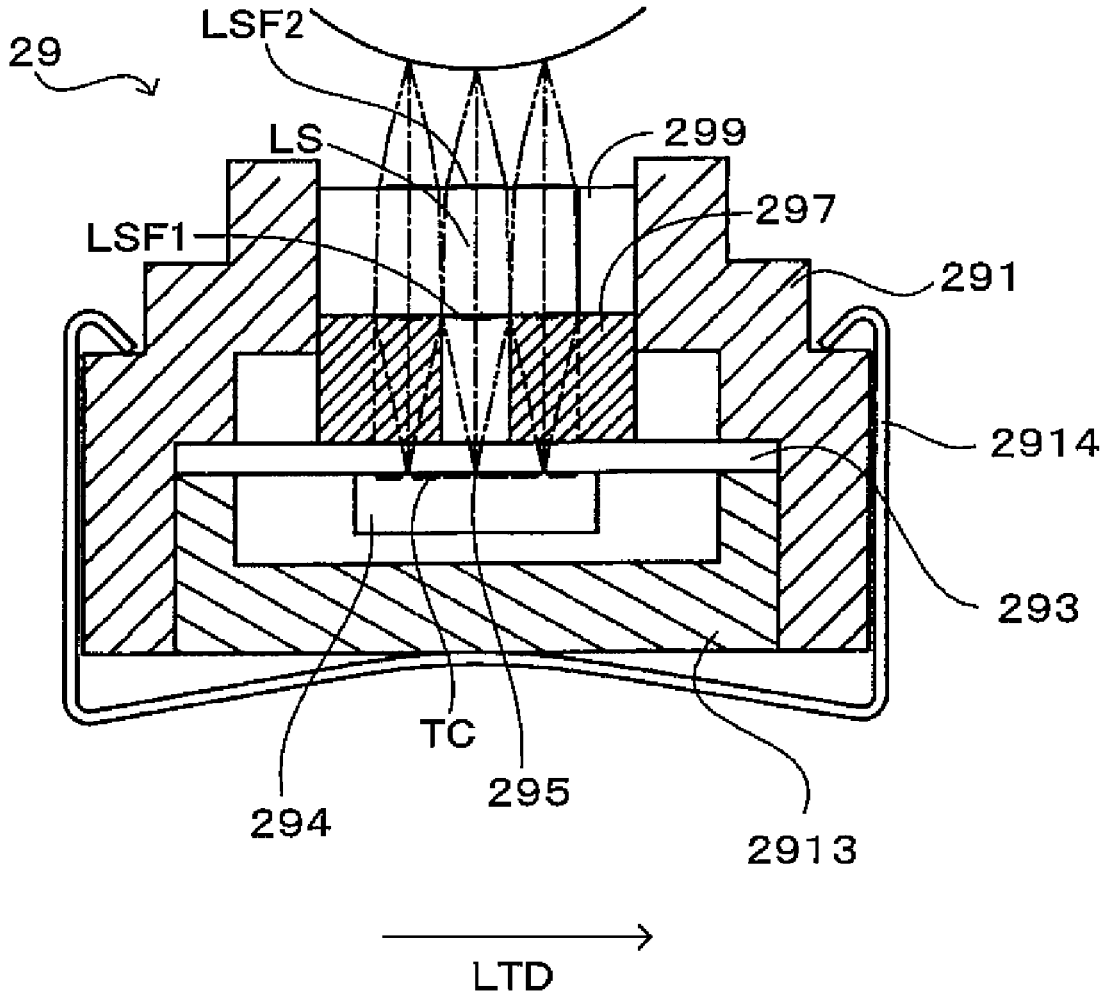
FIG. 6 is a sectional view along a width direction of the line head shown in FIG. 5.

FIG. 5 is a perspective view schematically showing a line head, and FIG. 6 is a sectional view along a width direction of the line head shown in FIG. 5. As described above, the line head 29 is arranged to face the photosensitive drum 21 such that the longitudinal direction LGD corresponds to the main scanning direction MD and the width direction LTD corresponds to the sub scanning direction SD. The longitudinal direction LGD and the width direction LTD are substantially normal to each other. The line head 29 includes a case 291, and a positioning pin 2911 and a screw insertion hole 2912 are provided at each of the opposite ends of such a case 291 in the longitudinal direction LGD. The line head 29 is positioned relative to the photosensitive drum 21 by fitting such positioning pins 2911 into positioning holes (not shown) perforated in a photosensitive drum cover (not shown) covering the photosensitive drum 21 and positioned relative to the photosensitive drum 21. Further, the line head 29 is positioned and fixed relative to the photosensitive drum 21 by screwing fixing screws into screw holes (not shown) of the photosensitive drum cover via the screw insertion holes 2912 to be fixed.

The case 291 carries a lens array 299 at a position facing the surface of the photosensitive drum 21, and includes a light shielding member 297 and a head substrate 293 inside, the light shielding member 297 being closer to the lens array 299 than the head substrate 293. The head substrate 293 is made of a transmissive material (glass for instance). Further, a plurality of light emitting element groups 295, each of which is a group of a plurality of light emitting elements, are provided on an under surface of the head substrate 293 (surface opposite to the lens array 299 out of two surfaces of the head substrate 293). The light emitting elements constituting the respective light emitting element groups 295 are bottom emission-type EL (electroluminescence) devices. Further, on the under surface of the head substrate 293, TFT circuits TC which control the driving of the light emitting elements of the light emitting element groups 295 are provided, which will be described in detail later. The light beams emitted from the respective light emitting element groups 295 propagate toward the light shielding member 297 after passing through the head substrate 293 from the under surface thereof to a top surface thereof.

The light shielding member 297 is perforated with a plurality of light guide holes 2971 in a one-to-one correspondence with the plurality of light emitting element groups 295. Further, as described later, lenses LS are provided corresponding to each light emitting element group 295 in the lens array 299, and the light guide holes 2971 are perforated to form from the light emitting element groups 295 toward the lenses LS. Since the light shielding member 297 is provided between the head substrate 293 and the lens array 299 in this way, out of light beams emitted from the light emitting element groups 295, those propagating toward other than the light guide holes 2971 corresponding to the light emitting element groups 295 are shielded by the light shielding member 297. Thus, all the lights emitted from one light emitting element group 295 propagate toward the lens array 299 via the same light guide hole 2971 and the mutual interference of the light beams emitted from different light emitting element groups 295 can be prevented by the light shielding member 297. The light beams having passed through the light guide holes 2971 perforated in the light shielding member 297 are imaged as spots on the surface of the photosensitive drum 21 by the lens array 299.

As shown in FIG. 6, an underside lid 2913 is pressed against the case 291 via the head substrate 293 by retainers 2914. Specifically, the retainers 2914 have elastic forces to press the underside lid 2913 toward the case 291, and seal the inside of the case 291 light-tight (that is, so that light does not leak from the inside of the case 291 and so that light does not intrude into the case 291 from the outside) by pressing the underside lid by means of the elastic force. It should be noted that a plurality of the retainers 2914 are provided at a plurality of positions in the longitudinal direction of the case 291. The light emitting element groups 295 are covered with a sealing member 294.

Figure 7:
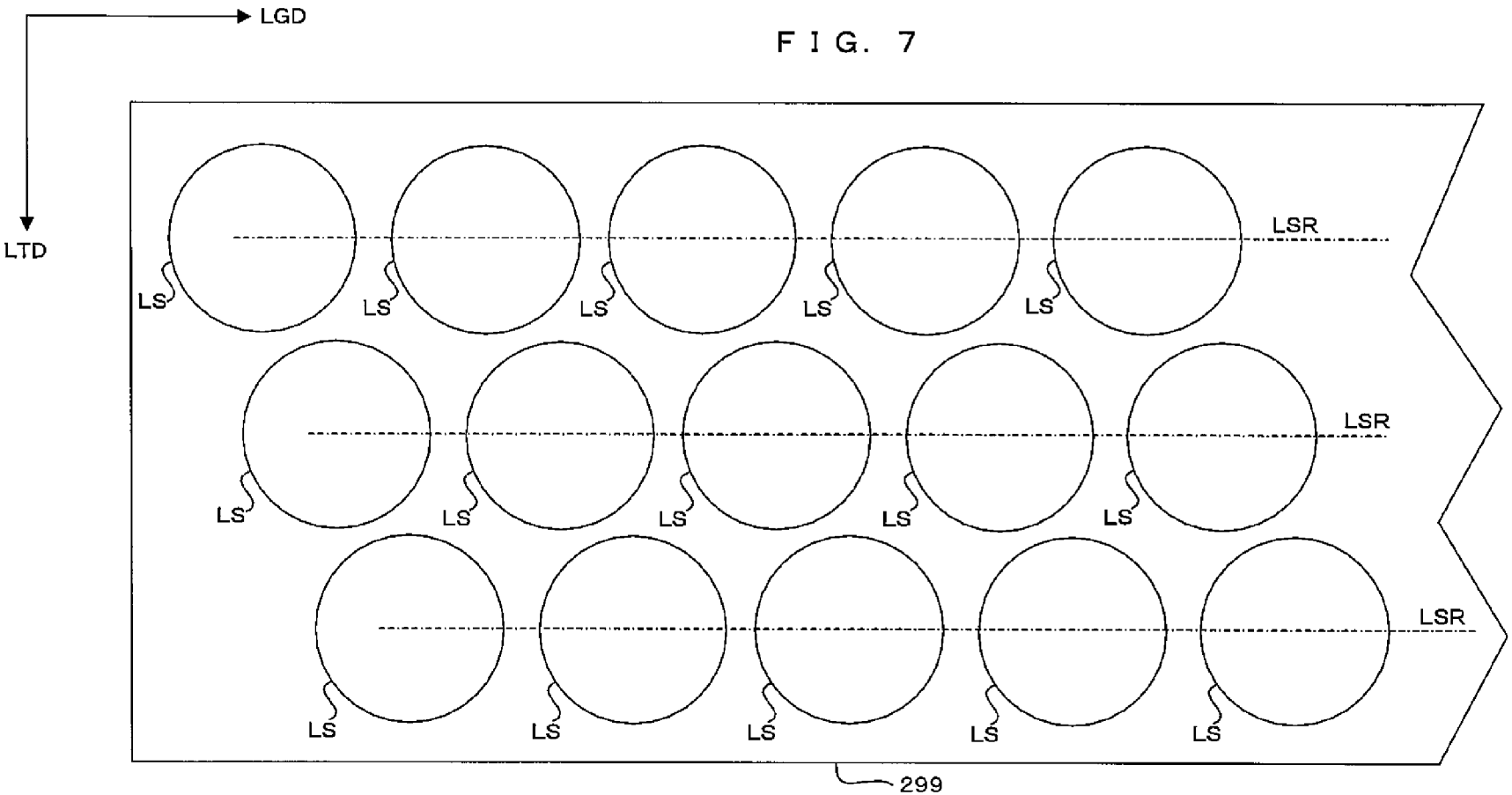
FIG. 7 is a schematic plan view of the lens array.

FIG. 7 is a schematic plan view of the lens array and corresponds to a case where the lens array is viewed from the image plane side (that is, from the surface of the photosensitive drum 21). As shown in FIG. 7, in this lens array 299, a plurality of lenses LS are arranged in the longitudinal direction LGD, thereby constituting lens rows LSR, and three lens rows LSR thus formed are arranged side by side in the width direction LTD. The three lens rows LSR are shifted from each other in the longitudinal direction LGD such that the positions of the lenses LS differ from each other in the longitudinal direction LGD. As a result, the positions of the lenses LS are different from each other in the longitudinal direction LGD.

Figure 8:
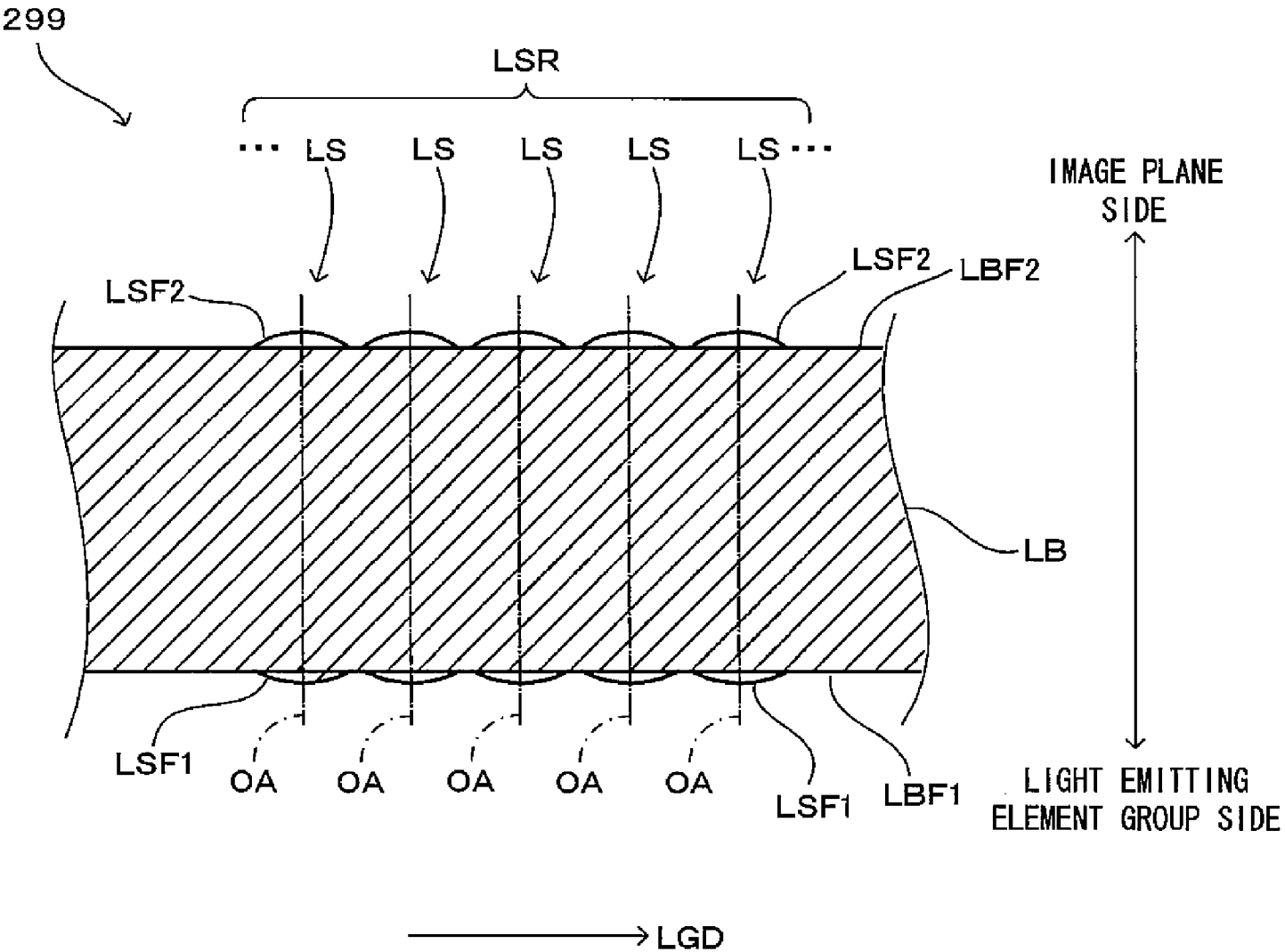
FIG. 8 is a cross sectional view of the lens array taken in the longitudinal direction.

FIG. 8 is a cross sectional view of the lens array taken in the longitudinal direction and corresponds to a case where the lens array is viewed in a cross section which includes the optical axes OA of the respective lenses. In FIG. 8, the upper side is the image plane side and the lower side is the light emitting element group side. In the lens array 299, one lens substrate LB made of glass is provided and two lens surfaces LSF1 and LSF2 are arranged in the direction of the optical axis OA and sandwiching the substrate LB, thereby constituting each lens LS. The lens surfaces LSF1 and LSF2 may be made of a light curing resin for instance. Of the two lens surfaces, the lens surface LSF1 is formed on the under surface LBF1 of the lens substrate LB, while the lens surface LSF2 is formed on the top surface LBF2 of the lens substrate LB. These lenses LS are arranged in the longitudinal direction LGD, whereby the lens rows LSR described above are formed.

Figure 9:
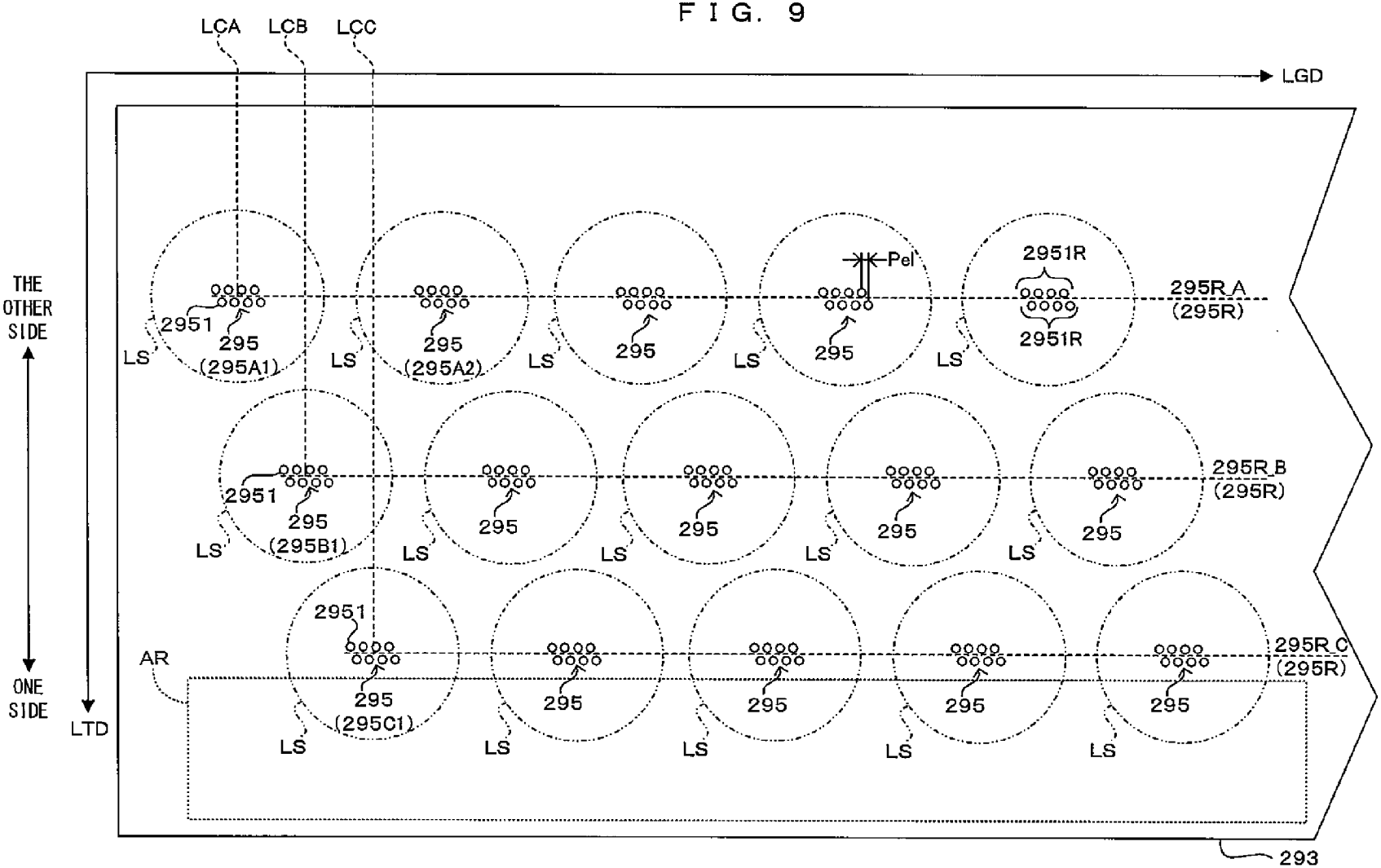
FIG. 9 is a diagram showing the construction of the under surface of the head substrate.

FIG. 9 is a diagram showing the construction of the under surface of the head substrate and corresponds to a case where the under surface of the head substrate is seen from the top surface. In FIG. 9, the lenses LS are shown by chain double-dashed line to show that the light emitting element groups 295 are provided in a one-to-one correspondence with the lenses LS, but not to show that the lenses LS are arranged on the under surface of the head substrate.

As shown in FIG. 9, the light emitting element groups 295, which are groups of the plurality of light emitting elements 2951, are provided on the under surface of the head substrate 293. Describing this in more detail, three (295R_A, 295R_B, 295R_C) light emitting element group rows 295R, which are formed by the plurality of light emitting element groups 295 which are arranged in the longitudinal direction LGD, are arranged side by side in the width direction LTD. In each one of the light emitting element group rows 295R_A through 295R_C, the plurality of light emitting element groups 295 are arranged side by side. The light emitting element group rows 295R are shifted from each other in the longitudinal direction LGD so that the positions of the light emitting element groups 295 are different from each other in the longitudinal direction LGD. Specifically, the positions LCA, LCB and LCC of the light emitting element groups 295A1, 295B1 and 295C1 in the longitudinal direction LGD are different from each other. In FIG. 9, the positions LCA, LCB and LCC are denoted at the feet of perpendiculars from the positions of the centers of gravity of the light emitting element groups 295A1, 295B1 and 295C1 to the axis of the longitudinal direction LGD.

In each light emitting element group 295, light emitting element rows 2951R, each formed by four light emitting elements 2951 arranged in the longitudinal direction LGD, are arranged side by side in the width direction LTD. These light emitting element rows 2951R are shifted from each other by a light emitting element pitch Pel in the longitudinal direction LGD, whereby the positions of the light emitting elements 2951 are different from each other in the longitudinal direction LGD. In this fashion, two light emitting element rows 2951R are in a staggered arrangement in each light emitting element group 295.

Figure 10:
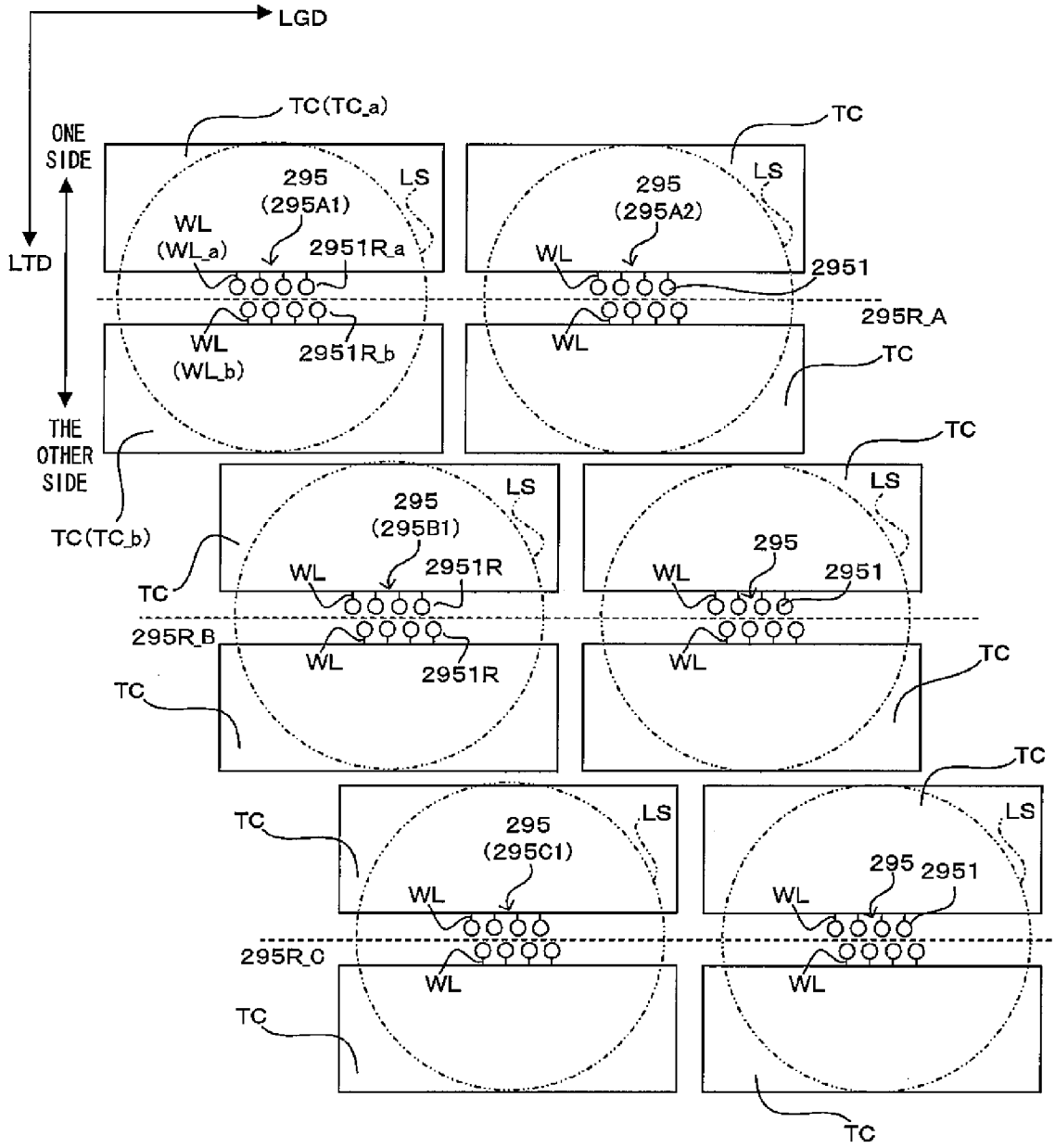
FIG. 10 is a diagram showing a positional relationship between the light emitting element groups and TFT circuits and showing the under surface of the head substrate according to the first embodiment.

FIG. 10 is a diagram showing a positional relationship between the light emitting element groups and TFT circuits and showing the under surface of the head substrate 293 according to the first embodiment. While the lenses LS are denoted at the two-dot chain line in FIG. 10 as well, this is to show that the light emitting element groups 295 are provided in a one-to-one correspondence with the lenses LS but does not mean that the lenses LS are formed on the under surface of the head substrate. As shown in FIG. 10, the TFT circuits and interconnection wires WL are provided on the under surface of the head substrate 293 in addition to the light emitting element groups 295. That is, the TFT circuits TC are formed on the both sides of each light emitting element group 295 in the width direction LTD. In other words, two TFT circuits TC are disposed sandwiching each light emitting element group 295 in the width direction LTD, and the two TFT circuits TC are provided adjacent to each light emitting element group 295.

The light emitting element groups 295 and the TFT circuits TC which are provided for the light emitting element groups 295 are connected by the interconnection wires WL. Describing this with the light emitting element group 295A1 which will serve as a representative light emitting element group, the interconnection wire WL_a connected to the light emitting element row 2951R_a, which is located at one side in the width direction LTD among the light emitting element rows 2951R which constitute the light emitting element group 295A1, is led out to the one side of the light emitting element row 2951R_a. The interconnection wire WL_a thus led out is connected to the TFT circuit TC_a which is provided at one side of the light emitting element group 295A1. Meanwhile, the interconnection wire WL_b, which is connected to the light emitting element row 2951R_b which is located at the other end side in the width direction LTD among the light emitting element rows 2951R which constitute the light emitting element group 295A1, is led out to the one side of the light emitting element row 2951R_b. The interconnection wire WL_b thus led out is connected to the TFT circuit TC_b which is provided at one side of the light emitting element group 295A1.

The TFT circuits TC are structured to control drive emission of the light emitting elements 2951. In short, each TFT circuit TC supplies a drive signal corresponding to video data VD to each light emitting element 2951 which belongs to the corresponding light emitting element group 295. Receiving the drive signal, the respective light emitting elements 2951 emit light beams which have mutually equal wavelengths. The respective light emitting elements 2951 to which the drive signals are given emit light beams of the same wavelength. The light emitting surfaces of the light emitting elements 2951 are so-called perfectly diffusing surface illuminants and the light beams emitted from the light emitting surfaces comply with Lambert's cosine law. The lenses LS focus these light beams as spots, whereby a latent image is formed on the surface of the photosensitive drum 21.

Figure 11:
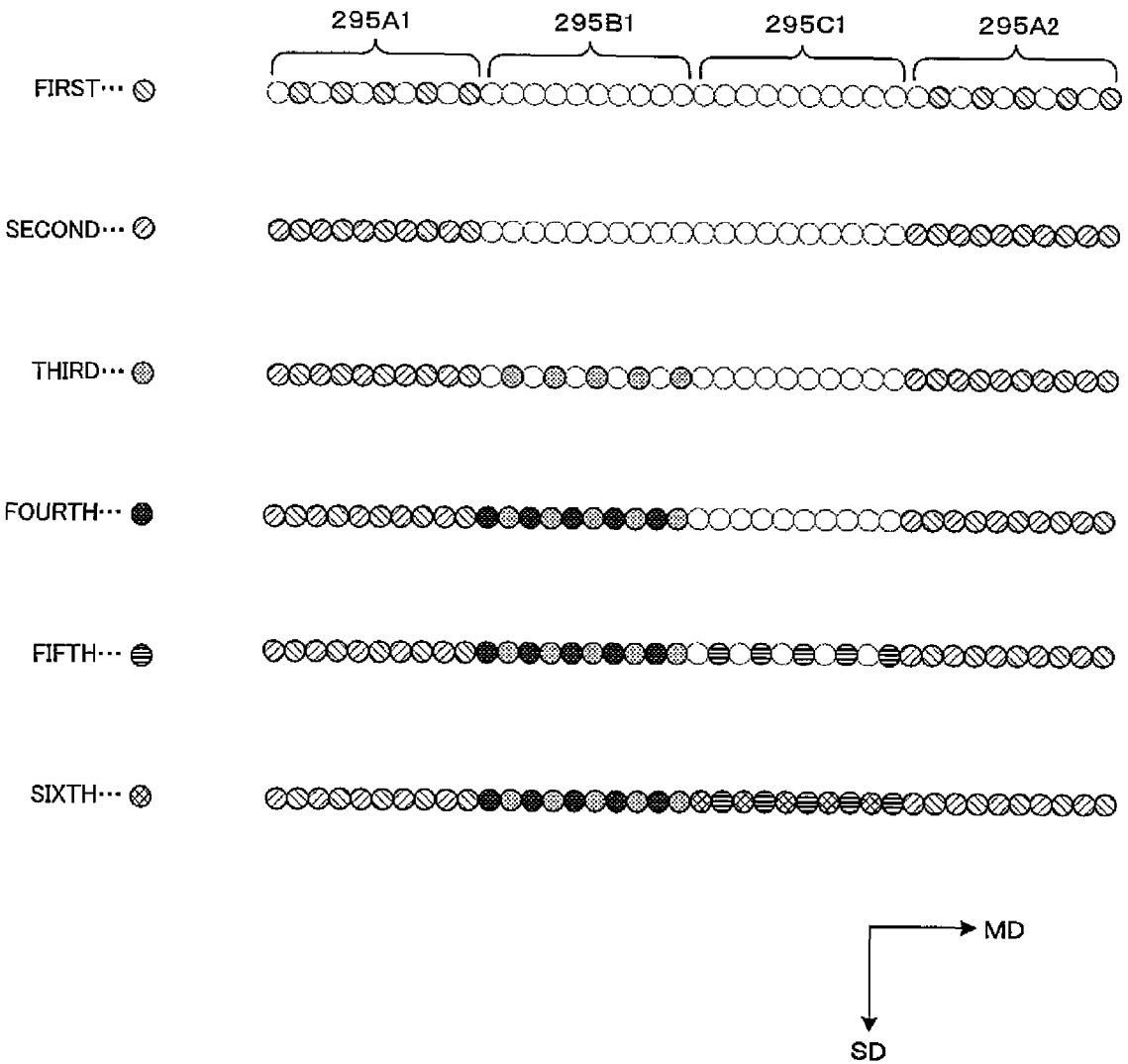
FIG. 11 is a diagram showing a spot forming operation by the above line head.

FIG. 11 is a diagram showing a spot forming operation by the above line head. The spot forming operation by the line head according to this embodiment is described below with reference to FIGS. 9 to 11. In order to facilitate the understanding of the invention, here is described a case where a line latent image is formed by aligning a plurality of spots on a straight line extending in the main scanning direction MD. Roughly, in such a latent image forming operation, the plurality of light emitting elements are driven for light emission at specified timings in accordance with the video data VD outputted from the head controller HC while the surface of the photosensitive drum 21 is conveyed in the sub scanning direction SD (the width direction LTD), whereby the plurality of spots are formed while being aligned on the straight line extending in the main scanning direction MD (the longitudinal direction LGD). This is described in detail below.

First of all, out of the light emitting element rows 2951R belonging to the most upstream light emitting element groups 295A1, 295A2, . . . in the width direction LTD, the light emitting element rows 2951R downstream in the width direction LTD are driven for light emission. A plurality of light beams emitted by such a light emitting operation are imaged on the surface of the photosensitive drum by the lenses LS. In this embodiment, the lenses LS have an inversion characteristic, so that the light beams from the light emitting elements 2951 are imaged in an inverted manner. In this way, spots are formed at hatched positions of a "FIRST" of FIG. 11. In FIG. 11, white circles represent spots that are not formed yet, but planned to be formed later. In FIG. 11, spots labeled by reference numerals 295C1, 295B1, 295A1 and 295C2 are those to be formed by the light emitting element groups 295 corresponding to the respective attached reference numerals.

Subsequently, out of the light emitting element rows 2951R belonging to the most upstream light emitting element groups 295A1, 295A2, . . . , the light emitting element rows 2951R upstream in the width direction LTD are driven for light emission. A plurality of light beams emitted by such a light emitting operation are imaged on the surface of the photosensitive drum by the lenses LS. In this way, spots are formed at hatched positions of a "SECOND" of FIG. 11. Here, the light emitting element rows 2951R are successively driven for light emission from the one downstream in the width direction LTD in order to deal with the inversion characteristic of the lenses LS.

Subsequently, out of the light emitting element rows 2951R belonging to the second most upstream light emitting element groups 295B1, . . . in the width direction LTD, the light emitting element rows 2951R downstream in the width direction LTD are driven for light emission. A plurality of light beams emitted by such a light emitting operation are imaged on the surface of the photosensitive drum by the lenses LS. In this way, spots are formed at hatched positions of a "THIRD" of FIG. 11.

Subsequently, out of the light emitting element rows 2951R belonging to the second most upstream light emitting element groups 295B1, . . . , the light emitting element rows 2951R upstream in the width direction LTD are driven for light emission. A plurality of light beams emitted by such a light emitting operation are imaged on the surface of the photosensitive drum by the lenses LS. In this way, spots are formed at hatched positions of a "FOURTH" of FIG. 11.

Subsequently, out of the light emitting element rows 2951R belonging to the third most upstream light emitting element groups 295C1, . . . in the width direction LTD, the light emitting element rows 2951R downstream in the width direction LTD are driven for light emission. A plurality of light beams emitted by such a light emitting operation are imaged on the surface of the photosensitive drum by the lenses LS. In this way, spots are formed at hatched positions of a "FIFTH" of FIG. 11.

Finally, out of the light emitting element rows 2951R belonging to the third most upstream light emitting element groups 295C1, . . . , the light emitting element rows 2951R upstream in the width direction LTD are driven for light emission. A plurality of light beams emitted by such a light emitting operation are imaged on the surface of the photosensitive drum by the lenses LS. In this way, spots are formed at hatched positions of a "SIXTH" of FIG. 11. By performing the first to the sixth light emitting operations in this way, a plurality of spots are formed while being aligned on the straight line extending in the longitudinal direction LGD (the main scanning direction MD).

By the way, the line head 29 as described above may give rise to a problem that the amounts of light vary among the plurality of light emitting elements 2951. The cause of such a variation of the amounts of light could be different frequencies at which the plurality of light emitting elements 2951 emit light, for example. That is, when the plurality of light emitting elements 2951 emit light at different frequencies, some light emitting elements 2951 may reach the end of their lifetime relatively early and the amounts of light emitted from them may become smaller than those from the other light emitting elements 2951. Since organic EL elements in particular have a shorter lifetime than LED elements and the like, where organic ELs are used as the light emitting elements 2951 as in the embodiment above, this problem is significant. Considering this, the line head 29 according to this embodiment is equipped with optical sensors which detect the amounts of light of light beams emitted from the light emitting elements 2951.

Figure 12:
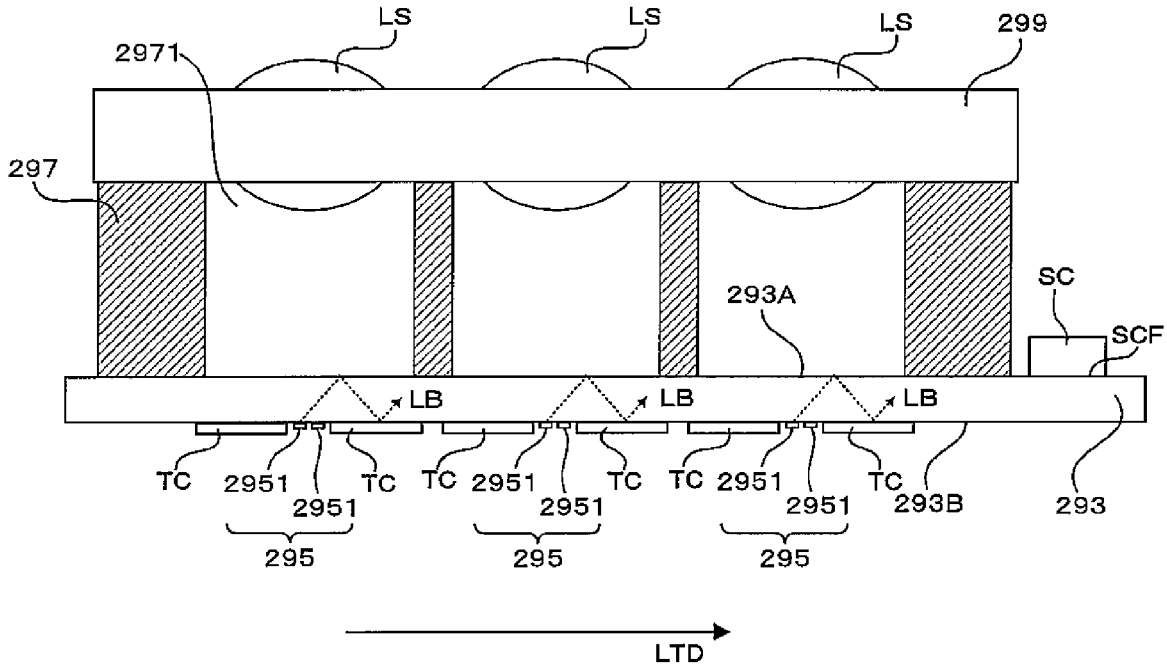
FIGS. 12 and 13 are diagrams showing the arrangement of the optical sensors in the first embodiment.
Figure 13:
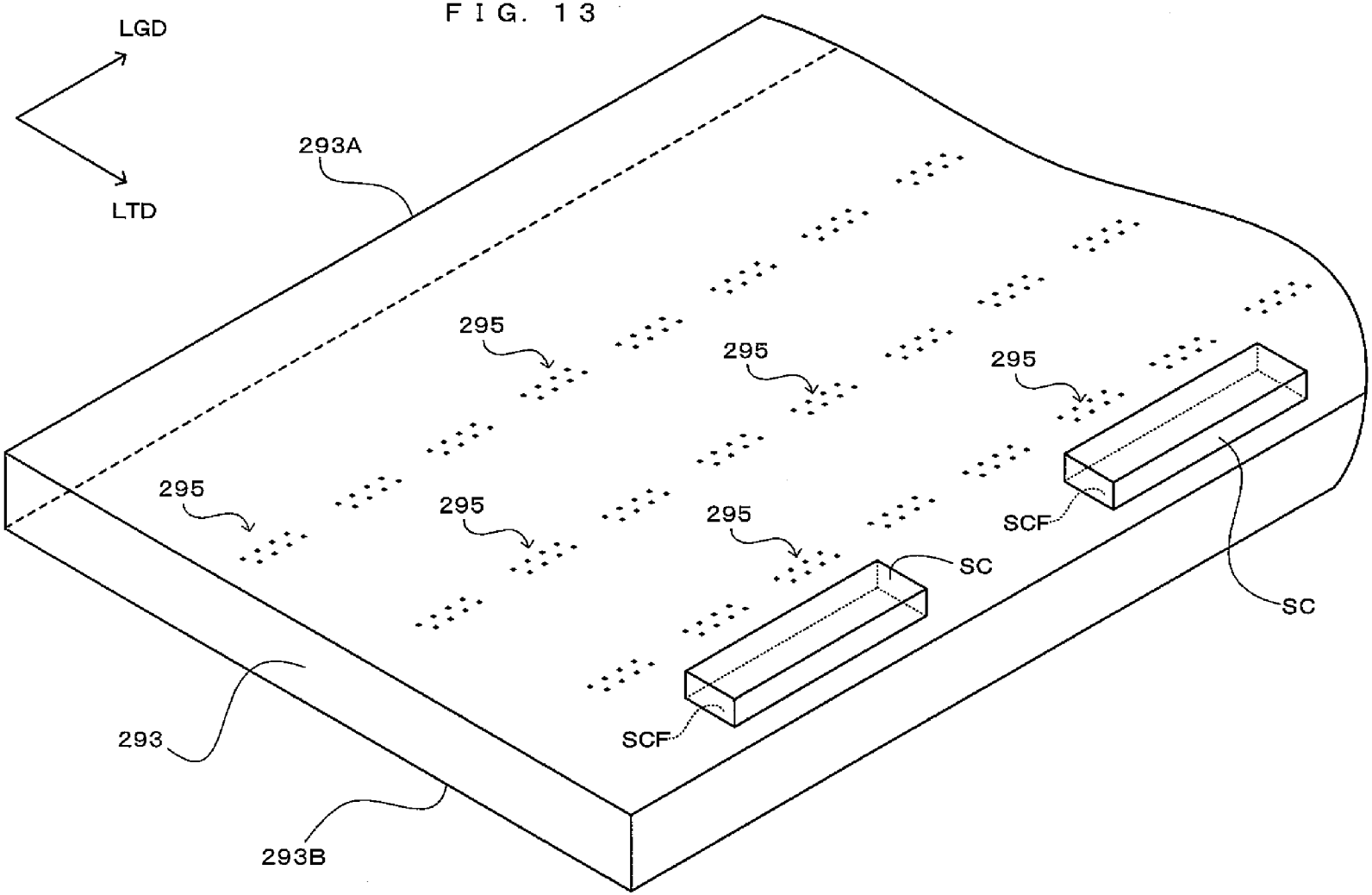

FIGS. 12 and 13 are diagrams showing the arrangement of the optical sensors in the first embodiment. FIG. 12 is a diagram of the line head 29 as it is viewed in the longitudinal direction LGD, while FIG. 13 is a perspective view of the head substrate 293. As shown in FIG. 13, the long-axis direction of the head substrate 293 is the longitudinal direction LGD which corresponds to the main scanning direction MD and the short-axis direction of the head substrate 293 is the width direction LTD which corresponds to the sub scanning direction SD. As described earlier, the plurality of light emitting element groups 295 and the TFT circuits TC which control driving of light emission of the respective light emitting element groups 295 are provided on the under surface 293B of the head substrate 293. In FIG. 13, the TFT circuits TC are not shown.

As shown in FIG. 13, the plurality of optical sensors SC which are arranged equidistant from each other in the longitudinal direction LGD are provided on the top surface 293A of the head substrate 293. Each optical sensor SC is located on the downstream side to the light shielding member 297 in the width direction LTD. The light receiving surfaces SCF of the optical sensors SC are opposed to the top surface 293A of the head substrate 293 and bonded to the top surface 293A of the head substrate by a transparent optical adhesive. The optical sensors SC provided in this manner are capable of detecting light beams emitted from the respective light emitting elements 2951. In other words, all light beams emitted from the light emitting elements 2951 do not necessarily exit from the top surface 293A of the head substrate 293: the top surface 293A reflects some light beams toward the under surface 293B. Further, the under surface 293B further reflects some reflected light beams toward the top surface 293A. To particularly note, since the TFT circuits TC are provided on the under surface 293B of the head substrate, the TFT circuits TC function as a reflection film in the first embodiment. The under surface 293B of the head substrate is therefore capable of reflecting light beams at a high reflectance ratio.

Some light beams (namely, the light beams LB denoted at the broken line in FIG. 12) emitted from the light emitting elements 2951, while repeatedly reflected between the top surface 293A and the under surface 293B of the head substrate 293 in this fashion, propagate through the head substrate 293 and impinge upon the optical sensors SC. The optical sensors SC detect the light beams impinging upon the light receiving surfaces SCF, and output detection values to the engine controller EC.

In the first embodiment, driving of the respective light emitting elements 2951 is controlled in accordance with the detection result obtained by the optical sensors SC such that the amounts of light from the respective light emitting elements 2951 will become uniform. The drive controlling operation, which will now be described below, is performed based on a predetermined correction coefficient. The correction coefficient is determined in advance during assembling, shipping or the like of the line head 29. Calculation of the correction coefficient will therefore be described first, followed by a description on the drive controlling operation.

For calculation of the correction coefficient, during assembling or shipping of the line head 29 or at other timing, the light emitting elements 2951 emit light beams and the amounts of light at spots formed at corresponding positions on the surface of the photosensitive drum 21 are measured. The amount of light from each light emitting element 2951 is measured. Describing this in more detail, the line head 29 is attached to an inspection jig. The inspection jig is equipped with a light amount detector which detects the light amounts of the light beams emitted from the respective light emitting elements 2951 of the line head 29 at an image-plane position which corresponds to the surface of the photosensitive drum 21. The light amount detector may be one detector which detects, while moving, the amounts of light of light beams from the respective light emitting elements 2951, or detectors which are provided for the respective light emitting elements 2951. While the respective light emitting elements 2951 emit light one after another, the light amount detector of the inspection jig yields detection values Pgn and the optical sensors SC of the line head 29 yield detection values Phn, where the symbol n denotes the n-th light emitting element. The correction coefficient Pgn/Phn can thus be calculated as for each light emitting element 2951. The correction coefficient Pgn/Phn calculated in this manner is stored in the engine controller EC for instance, which is shown in FIG. 4. The drive controlling operation is executed based on the correction coefficient Pgn/Phn as described next.

During the drive controlling operation, the variation of the amount of light among the light emitting elements 2951 is detected first. The detection of the variation of the amount of light is performed while the ordinary image forming operation is not executed, for example, at the time of turning on of the image forming apparatus, prior to the image forming operation, during a period between one paper and other. To be more precise, the detection values at the optical sensors SC are measured while the respective light emitting elements 2951 emit light one after another. The measurement value thus obtained is multiplied by the correction coefficient Pgn/Phn, thereby calculating the amounts of light at spots formed by the respective light emitting elements 2951 on the surface of the photosensitive drum 21.

In the event that the calculated amounts of light vary and a desired amount of light is not realized, driving of the light emitting elements 2951 is controlled so as to obtain the desired amount of light. That is, the desired amount of light is compared with the calculated amounts of light and a driving current for the light emitting elements 2951 is adjusted so that the calculated amounts of light will be equal to the desired amount of light. The TFT circuits TC then supply thus adjusted driving current to the respective light emitting elements 2951. As the TFT circuits TC drive the light emitting elements 2951 in this manner, the amounts of light of light beams emitted from the light emitting elements 2951 become uniform. The engine controller EC for instance may store information regarding the desired amount of light, a program for executing the drive controlling operation, etc.

As described with reference to FIG. 10, the TFT circuits TC are provided on the both sides of the light emitting element groups 295 in the width direction LTD according to the first embodiment. This makes it possible to lead the interconnection wires WL connected with the light emitting elements 2951 of the light emitting element groups 295 to the both sides in the width direction LTD, thereby improving the freedom of installing the interconnection wires WL.

In addition, the TFT circuits are provided adjacent to the light emitting element groups 295 in the first embodiment (FIG. 10). This makes it possible to shorten the interconnection wires WL from the TFT circuits to the light emitting element groups 295, and hence, to provide the light emitting elements 2951 with a drive signal which is less dampening induced by a floating capacitance, etc.

Further, in the first embodiment, the TFT circuits TC are provided on one-side surface of the head substrate 293. Since the TFT circuits TC function as a reflection film which reflects light, it is possible to increase the amount of light which impinges upon the optical sensors SC. It is therefore possible in the first embodiment to control driving of light emission at a high accuracy.

Further, in the first embodiment, the light shielding member 297 is provided, for the respective light emitting element groups 295, with the light guide holes 2971 which are bored from the light emitting element groups 295 toward the lenses (FIGS. 5 and 6), whereby the favorable exposure operation is realized. In other words, light beams from each light emitting element group 295 are focused by the lens LS which is provided for this light emitting element group 295, which achieves exposure operation in the first embodiment. Hence, to realize favorable exposure operation, it is desirable that each lens LS receives only those light beams emitted from the corresponding light emitting element group 295 and that incidence of other light beams (ghost light) upon each lens LS is suppressed as much as possible. In this regard, it is possible according to the first embodiment to block such ghost light with the light shielding member 297. As a result, incidence of ghost light upon the lenses LS is suppressed, which makes it possible to perform excellent exposure operation.

In addition, the light receiving surfaces SCF of the optical sensors SC are opposed to the top surface 293A of the head substrate and bonded to the top surface 293A of the head substrate of the head substrate by a transparent optical adhesive. This permits light beams heading for the light receiving surfaces SCF from the top surface 293A of the head substrate to impinge upon the light receiving surfaces SCF via the optical adhesive. Bonding using the optical adhesive in this way removes the interface between the top surface 293A of the head substrate and the optical sensors SC and suppresses unwanted reflection of light beams between the top surface 293A of the head substrate and the optical sensors SC. As a result, the light incident upon the light receiving surfaces SCF is increased, thereby realizing even more accurate control of driving of light emission.

Further, in the first embodiment, the plurality of optical sensors SC are arranged on the head substrate 293. It is therefore possible to detect the amounts of light from the light emitting elements at a high accuracy.

C. Second Embodiment

Figure 14:
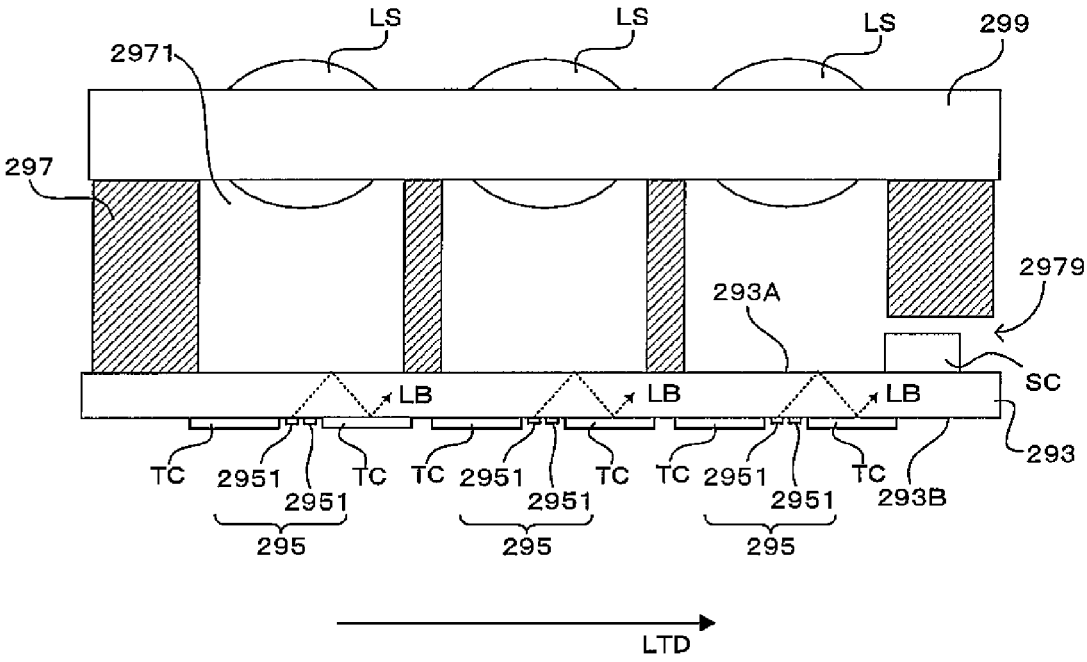
FIG. 14 is a diagram showing the structure of a line head according to a second embodiment.
Figure 15:
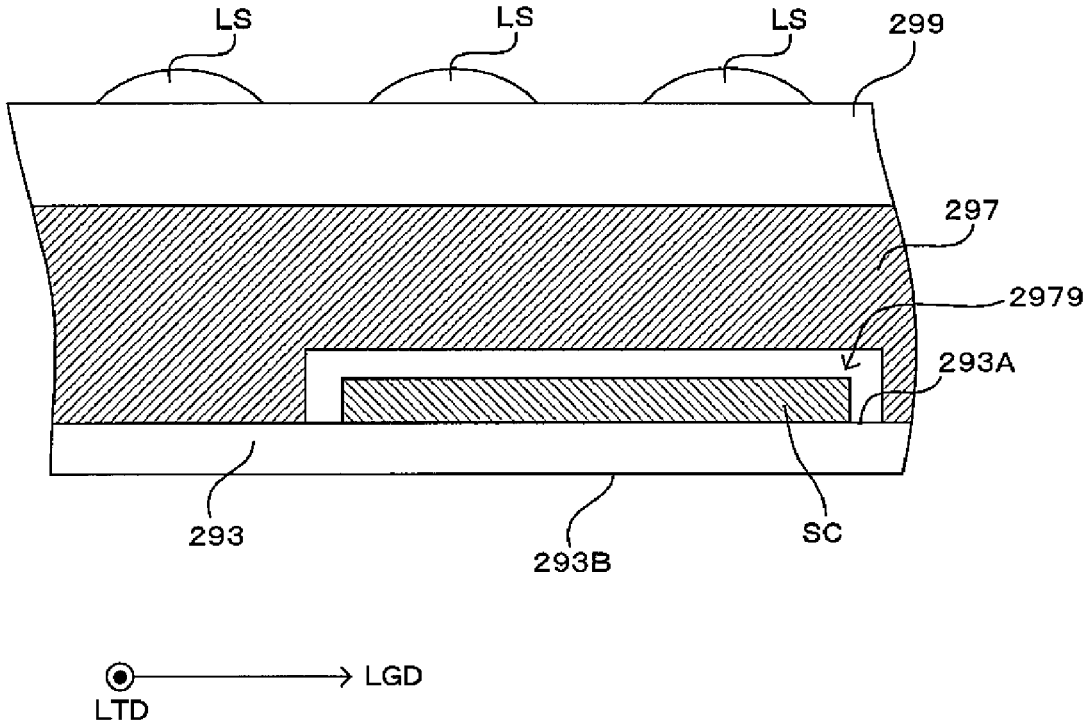
FIG. 15 is a partial side view of the line head of FIG. 14 as it is viewed from the right-hand side.

FIG. 14 is a diagram showing the structure of a line head according to a second embodiment. FIG. 15 is a partial side view of the line head of FIG. 14 as it is viewed from the right-hand side. Differences from the first embodiment will mainly be described hereinafter and the same aspects as those in the first embodiment will be denoted at corresponding reference symbols but will not be described. As shown in FIGS. 14 and 15, in the second embodiment as well, the light emitting element groups 295 are formed and the TFT circuits TC are arranged on the both sides of the light emitting element groups 295 in the width direction on the under surface of the head substrate 293. Hence, as in the first embodiment, it is possible to lead the interconnection wires connected with the light emitting elements 2951 of the light emitting element groups 295 out to the both sides in the width direction LTD, thereby improving the freedom of installing the interconnection wires WL.

To be noted as for the second embodiment is the arrangement of the optical sensors SC. As shown in FIGS. 14 and 15, in the second embodiment, through holes 2979 are formed at one end of the light shielding member 297 in the width direction LTD. The through holes 2979 are bored from outside the light shielding member 297 toward the light guide holes 2971, and the optical sensors SC are located inside the through holes 2979. Further, the optical sensors SC are positioned such that they are partially inside the light guide holes 2971 (FIG. 14). It is therefore possible for the optical sensors SC to directly detect light beams which propagate inside the light guide holes 2971. Due to this, the accuracy of detecting light beams is better and it is possible to detect the amounts of light at an even higher accuracy according to the second embodiment.

D. Third Embodiment

Figure 16:
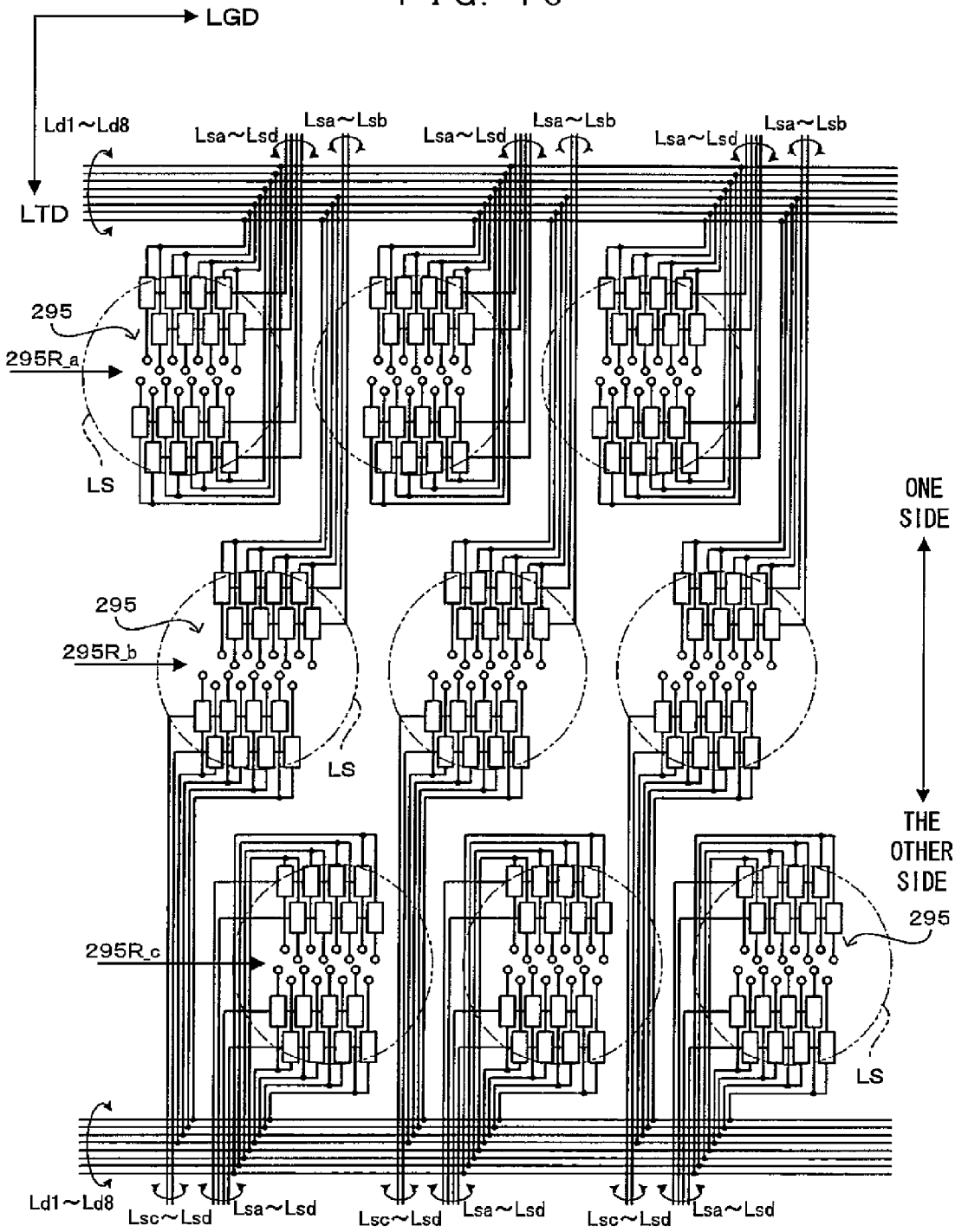
FIG. 16 is a partial plan view showing the structure of the under surface of the head substrate according to a third embodiment.
Figure 17:
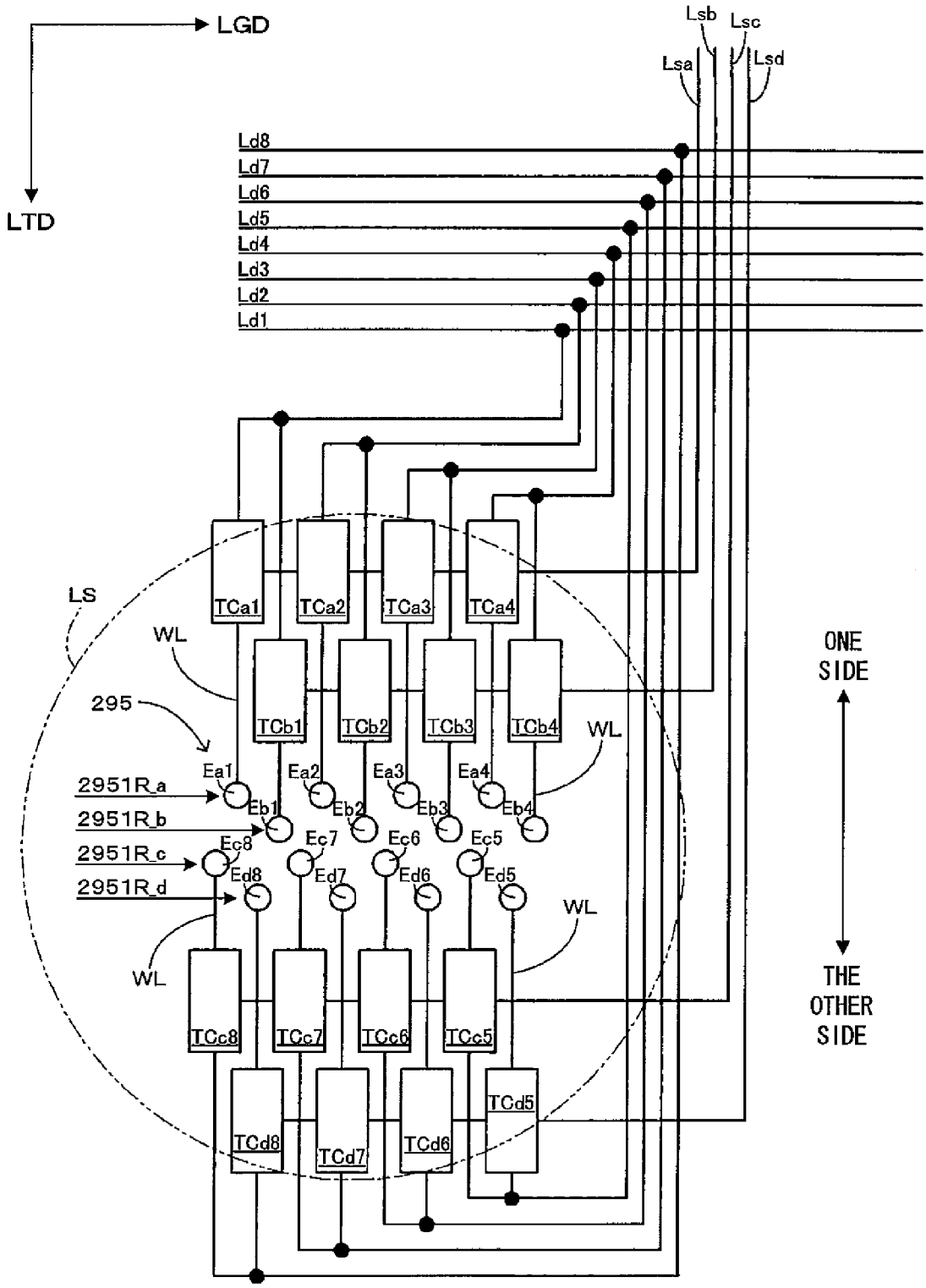
FIG. 17 is a partial plan view showing an expanded structure near one light emitting element group which is shown in FIG. 16.

FIG. 16 is a partial plan view showing the structure of the under surface of the head substrate according to a third embodiment, and FIG. 17 is a partial plan view showing an expanded structure near one light emitting element group which is shown in FIG. 16. While the lenses LS are denoted at the dashed-dotted line in FIGS. 16 and 17, this is to show that the light emitting element groups 295 are provided in a one-to-one correspondence with the lenses LS but does not mean that the lenses LS are formed on the under surface of the head substrate.

As shown in FIG. 17, sixteen light emitting elements Ea1 through Ea4, Eb1 through Eb4, Ec5 through Ec8 and Ed5 through Ed8 constitute one light emitting element group 295. The sixteen light emitting elements are arranged as follows. Specifically, four light emitting elements (which may for instance be the light emitting elements Ea1 through Ea4) among them are arranged linearly side by side in the longitudinal direction LGD, thereby forming one light emitting element row (which may for instance be the light emitting element row 2951R_a). The four light emitting element rows 2951R_a through 2951R_d are arranged in this order in the width direction LTD. Further, the light emitting element rows 2951R_a through 2951R_d are shifted from each other in the longitudinal direction LGD so that the positions of the respective light emitting elements are different from each other in the longitudinal direction LGD.

Further, in the third embodiment, one TFT circuit is provided for one light emitting element (for example, the TFT circuit TCa1 for the light emitting element Ea1). Although not shown, a power supply line is connected with the TFT circuits. In addition, the TFT circuits (for example, the TFT circuits TCa1 through TCa4) provided for the same light emitting element row (for example, the light emitting element row 2951R_a) are arranged linearly in the longitudinal direction LGD. The TFT circuits TCa1 through TCa4 and TCb1 through TCb4 provided respectively for the light emitting elements belonging to the light emitting element rows 2951R_a and 2951R_b are located on one side to the light emitting element groups 295 in the width direction LTD. The TFT circuits TCc5 through TCa8 and TCd5 through TCd8 provided respectively for the light emitting elements belonging to the light emitting element rows 2951R_c and 2951R_d are located on the other side to the light emitting element groups 295 in the width direction LTD. The light emitting element groups 295 are therefore located between the TFT circuits TCa1 through TCa4, TCb1 through TCb4 and the TFT circuits TCc5 through TCc8, TCd5 through TCd8.

The interconnection wires WL connect the light emitting elements with the corresponding TFT circuits (for example, the light emitting element Ea1 with the TFT circuit TCa1). That is, the interconnection wires WL led out to one side in the width direction LTD from the respective light emitting elements belonging to the light emitting element rows 2951R_a and 2951R_b are connected with the TFT circuits TCa1 through TCa4 and TCb1 through TCb4. Further, the interconnection wires WL led out to the other side in the width direction LTD from the light emitting elements belonging to the light emitting element rows 2951R_c and 2951R_d are connected with the TFT circuits TCc5 through TCa8 and TCd5 through TCd8.

In this embodiment, the light emitting element groups 295 are thus located between the TFT circuits TCa1 through TCa4, TCb1 through TCb4 and the TFT circuits TCc5 through TCc8, TCd5 through TCd8. It is therefore possible to lead the interconnection wires WL out to the both sides (namely, one side and the other side) in the width direction LTD and to improve the freedom of installing the interconnection wires.

Data lines and select lines are connected to the TFT circuits. That is, eight data lines Ld1 through Ld8 which are parallel to or approximately parallel to the longitudinal direction LGD are provided on the both sides of the light emitting elements and the TFT circuits in the width direction LTD (FIG. 16). Two TFT circuits share one data line. For instance, both the TFT circuit TCa1 and the TFT circuit TCb1 are connected to the data line Ld1 by the interconnection wires. Further, four select lines Lsa through Lsd are provided for each light emitting element group 295. The select lines Lsa through Lsd are provided corresponding to the light emitting element rows 2951R_a through 2951R_d. For instance, the select line Lsa is connected with each one of the TFT circuits TCa1 through TCa4 which correspond to the light emitting element row 2951R_a.

Control of driving the light emitting elements using the data lines Ld1 through Ld8 and the select lines Lsa through Lsb will now be described with reference to an example of driving the light emitting element Ea1. First, the data line Ld1 receives data information corresponding to the video data VD. The select line Lsa is then activated, whereby the data information is written in the TFT circuit TCa1. The TFT circuit TCa1 holds thus written information and drives the light emitting element Ea1 based on the information.

E. Fourth Embodiment

Figure 18:
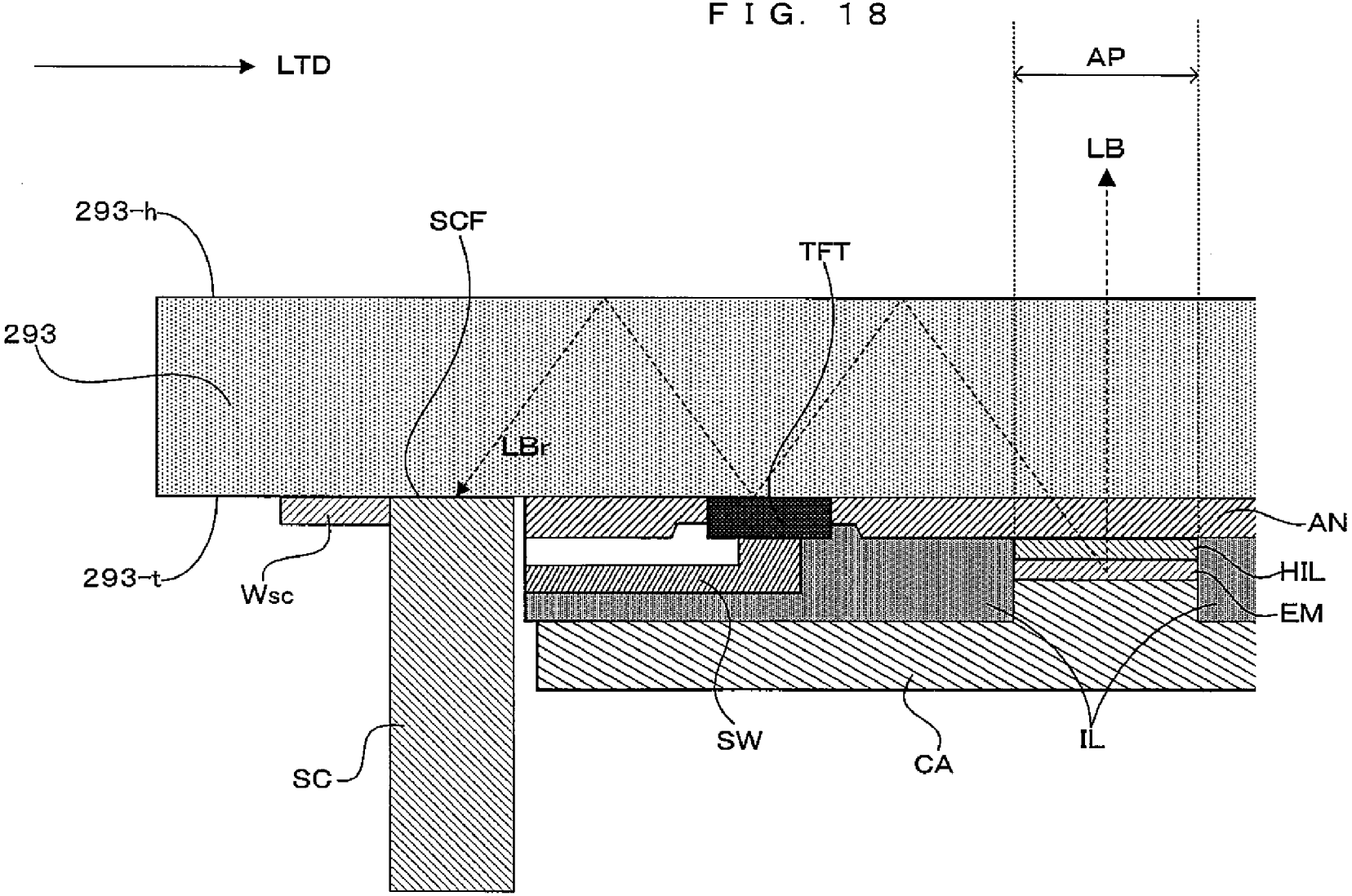
FIG. 18 is a width-direction partial cross sectional view showing the relationship between the light emitting elements and the optical sensors according to a fourth embodiment.
Figure 19:
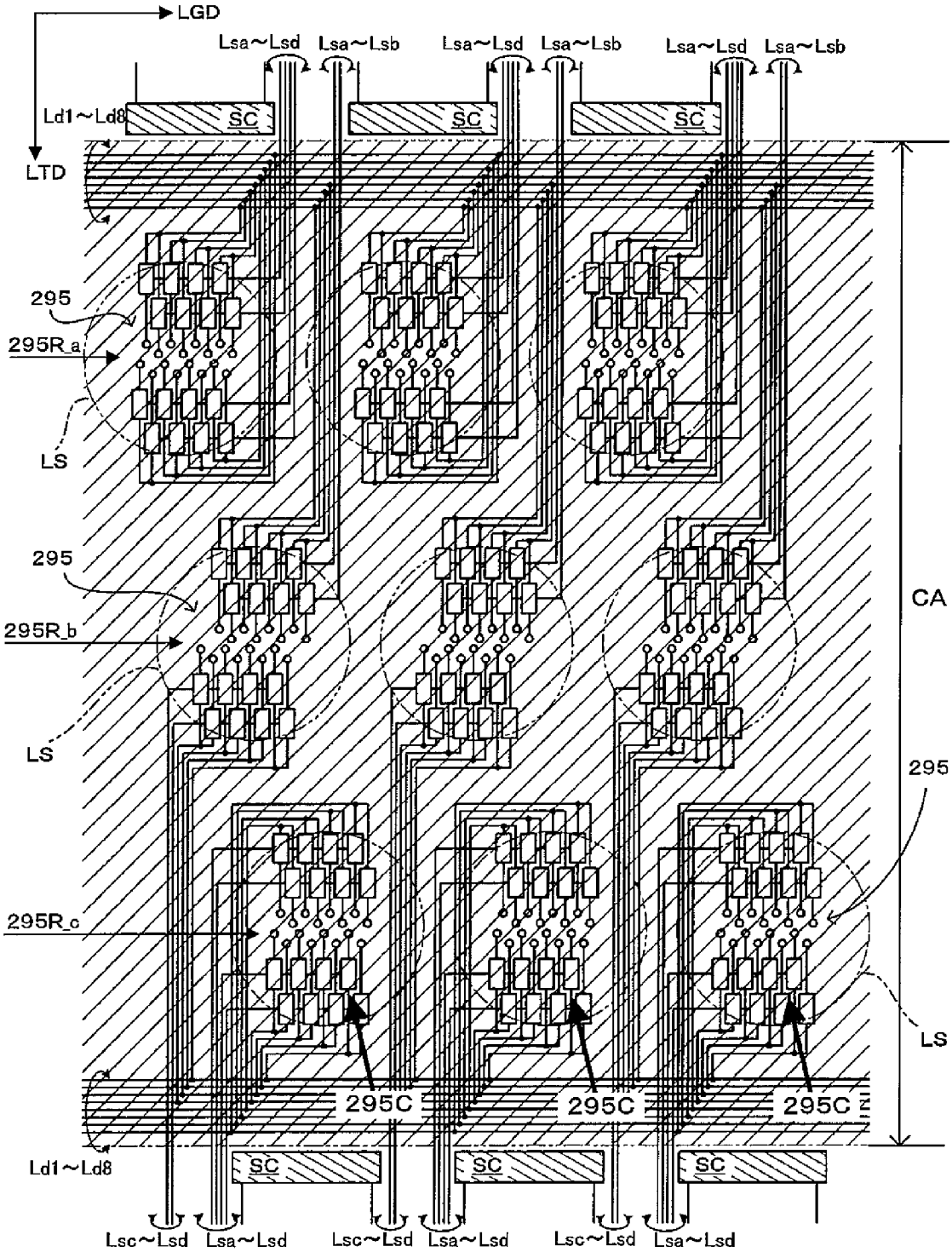
FIG. 19 is a plan view showing the relationship between the light emitting elements and the optical sensors according to the fourth embodiment.

FIG. 18 is a width-direction partial cross sectional view showing the relationship between the light emitting elements and the optical sensors according to a fourth embodiment. FIG. 19 is a plan view showing the relationship between the light emitting elements and the optical sensors according to the fourth embodiment and illustrates the structure of the under surface of the head substrate. While the lenses LS are denoted at the dashed-dotted line in FIG. 19, this is to show that the light emitting element groups 295 are provided in a one-to-one correspondence with the lenses LS but does not mean that the lenses LS are formed on the under surface of the head substrate.

An anode AD made of ITO (indium tin oxide) and a TFT are formed adjacent in the width direction LTD on the under surface 293-*t* of the head substrate 293. A switching electrode SW is formed on top of the TFT. In addition, an insulation layer IL is stacked upon the TFT, the switching electrode SW and the anode AN. An opening AP is formed in the insulation layer IL at a position facing the anode AN. In the opening AP, a hole transport layer HIL is stacked upon the anode AN and an emitter layer EM made of an organic EL material is further stacked upon the anode AN. A cathode CA is formed almost entirely on the emitter layer EM and the insulation layer IL. Such an organic EL element emits light in the following manner. That is, with application of an ON-voltage upon the switching electrode SW, the TFT turns on and holes are injected from the hole transport layer HIL into the emitter layer EM. At the same time, electrons are injected into the emitter layer EM from the cathode CA. When holes and electrons are combined with each other inside the emitter layer EM, the emitter layer EM emits light. Light LB from the emitter layer EM exits the top surface 293-*h* of the head substrate after impinging upon the under surface 293-*t* of the head substrate via the opening AP in the insulation layer IL and getting transmitted by the head substrate 293 which is made of a light transmissive member. In this fashion, the emitter layer EM made of the organic EL material emits light.

The plurality of optical sensors SC are arranged side by side in the longitudinal direction LGD, on the both sides of the region where the cathode CA is formed in the width direction LTD. The optical sensors detect light which is incident upon the light receiving surfaces SCF. The light receiving surfaces SCF are fixed to the under surface 293-*t* of the head substrate by an optical adhesive. As shown in FIG. 19, two optical sensors SC are provided for one light emitting element row 295C such that they sandwich the light emitting element row 295C in the width direction LTD. Sensor-interconnection wires Wsc are connected to the optical sensors SC, and detection signals from the optical sensors SC are outputted to the head controller HC via the sensor-interconnection wires Wsc. The optical sensors SC are used for correcting the amounts of light from the light emitting elements, which is as described earlier and therefore will not be described again.

As described above, in this embodiment, the optical sensors SC are provided on the head substrate 293. Hence, of light from the emitter layer EM, light LBr reflected inside the head substrate 293 (FIG. 18) can be detected by the optical sensors SC. Further, since TFTs as well are provided on the head substrate 293 and the TFTs reflect light from the emitter layer EM in this embodiment, it is possible to detect larger amounts of light by the optical sensors SC and to improve the accuracy of the detection result.

Further, the plurality of optical sensors SC are provided in this embodiment. This makes it possible to detect large amounts of light and to improve the accuracy of the result of detection.

Further, in this embodiment, the light receiving surfaces SCF of the optical sensors SC are bonded to the head substrate 293 by means of the optical adhesive. Therefore, the optical adhesive erases the interface between the head substrate 293 and the light receiving surfaces SCF. Hence, it is possible to suppress unwanted reflection of light at the boundaries between the head substrate 293 and the light receiving surfaces SCF. As a result, the amounts of light which impinge upon the light receiving surfaces SCF increase, which makes it possible to improve the accuracy of the result of detection.

F. Others

As described above, in the first and the second embodiments described above, the under surface 293B of the head substrate 293 corresponds to a "one-side surface" of the invention and the top surface 293A of the head substrate 293 corresponds to an "other-side surface" of the invention. In addition, the optical sensors SC correspond to a "detector" of the invention. The longitudinal direction LGD corresponds to a "first direction" of the invention, the width direction LTD corresponds to a "second direction" of the invention, and the photosensitive drum 21 corresponds to a "latent image carrier" of the invention.

Further, in the third and the fourth embodiments described above, the line head 29 corresponds to an "exposure head" of the invention. The light emitting element rows 2951R_a and 2951R_b correspond to a "first light emitting element" of the invention, while the light emitting element rows 2951R_c and 2951R_d correspond to a "second light emitting element" of the invention. Meanwhile, the TFT circuits TCa1 through TCa4 and TCb1 through TCb4 correspond to a "first TFT circuit" of the invention, and the TFT circuits TCc5 through TCc8 and TCd5 through TCd8 correspond to a "second TFT circuit" of the invention. The lenses LS correspond to an "imaging optical system" of the invention. The head substrate 293 corresponds to a "substrate" of the invention, the under surface 293-*t* of the head substrate corresponds to a "first surface of the substrate" of the invention and the top surface 293-*h* of the head substrate corresponds to a "second surface of the substrate" of the invention. Further, the optical sensors SC correspond to a "detector" of the invention.

The invention is not limited to the above embodiments and various changes other than the above can be made without departing from the gist thereof.

Figure 20:
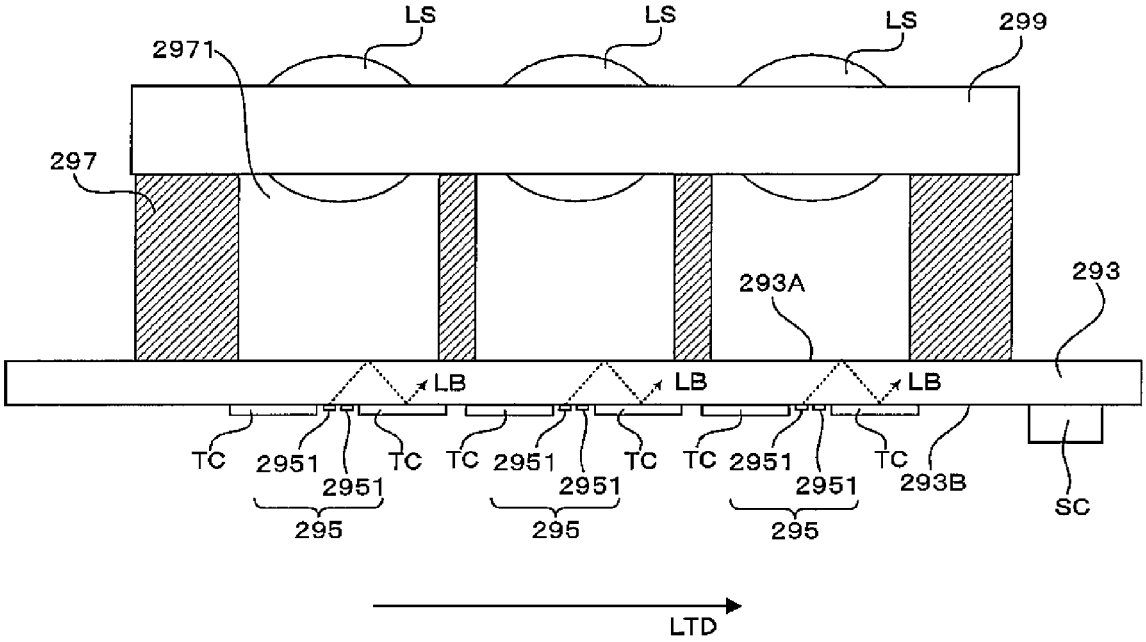
FIG. 20 is a diagram showing other arrangement mode of the optical sensors.
Figure 21:
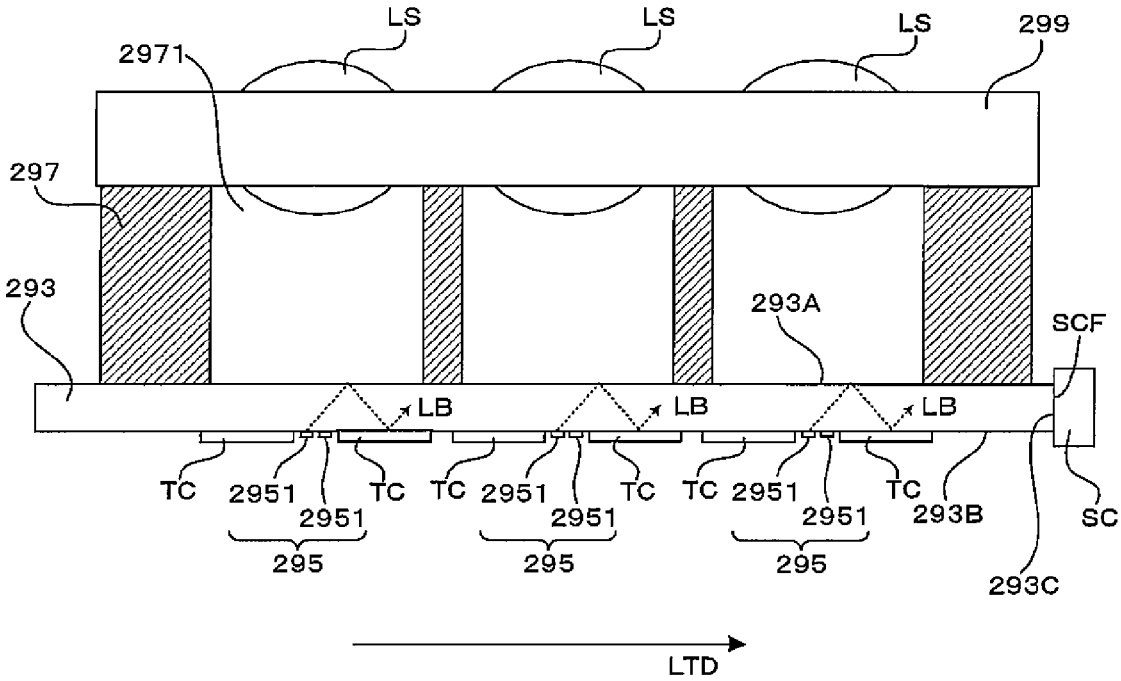
FIG. 21 is a diagram showing yet other arrangement mode of the optical sensors.

For instance, in the first and the second embodiments, although the optical sensors SC are arranged on the top surface 293A of the head substrate 293, the position of the optical sensors SC is not limited to this, and the optical sensors SC may be arranged as follows. In the description below, those sections common to those according to the above embodiments will be denoted at corresponding reference symbols but will not be described. FIG. 20 is a diagram showing other arrangement mode of the optical sensors. In the embodiment shown in FIG. 20, the optical sensors SC are arranged on the under surface 293B of the head substrate 293. FIG. 21 is a diagram showing yet other arrangement mode of the optical sensors. In the embodiment in FIG. 21, the optical sensors SC are arranged on an end surface 293C of the head substrate 293 in the width direction LTD.

Figure 22:
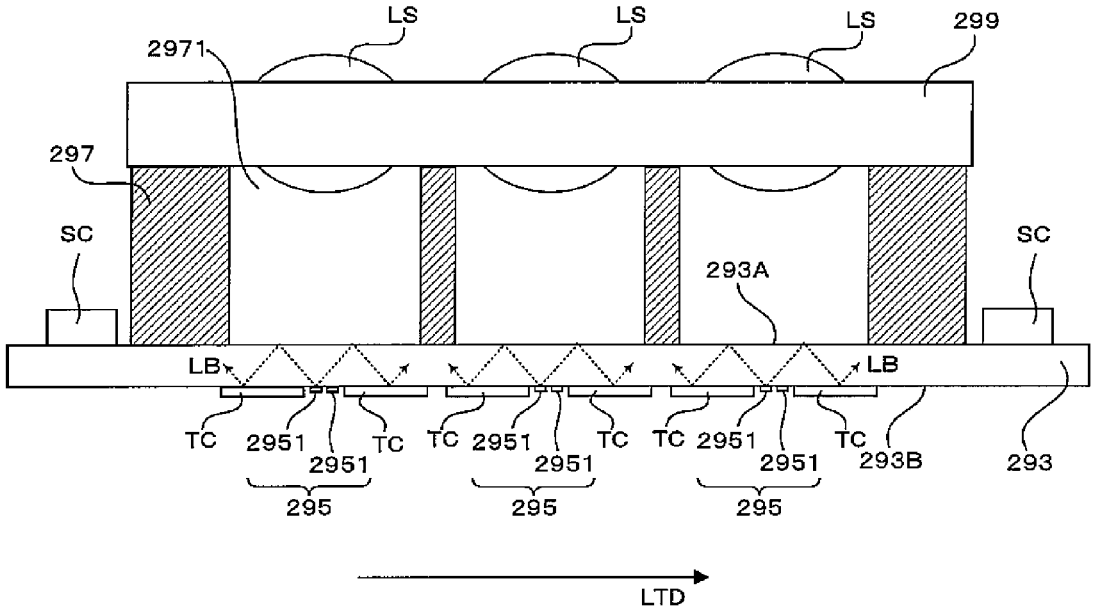
FIG. 22 is a diagram showing a case where the optical sensors are arranged on the both sides in the width direction.

In addition, the optical sensors SC are provided only on one side in the width direction LTD in the first and the second embodiments described above. However, the optical sensors SC may be provided on the both sides in the width direction LTD as shown in FIG. 22. FIG. 22 is a diagram showing a case where the optical sensors are arranged on the both sides in the width direction.

Further, in the first and the second embodiments, four light emitting elements 2951 arranged in the longitudinal direction LGD side by side constitute each light emitting element row 2951R (FIG. 10). However, the number of the light emitting elements 2951 constituting each light emitting element row 2951R is not limited to four. In addition, two light emitting element rows 2951R constitute each light emitting element group 295 (FIG. 10). However, the number of the light emitting element rows 2951R constituting each light emitting element group 295 is not limited to this. That is, the light emitting element rows 2951R and the light emitting element groups 295 may be structured as described below.

Figure 23:
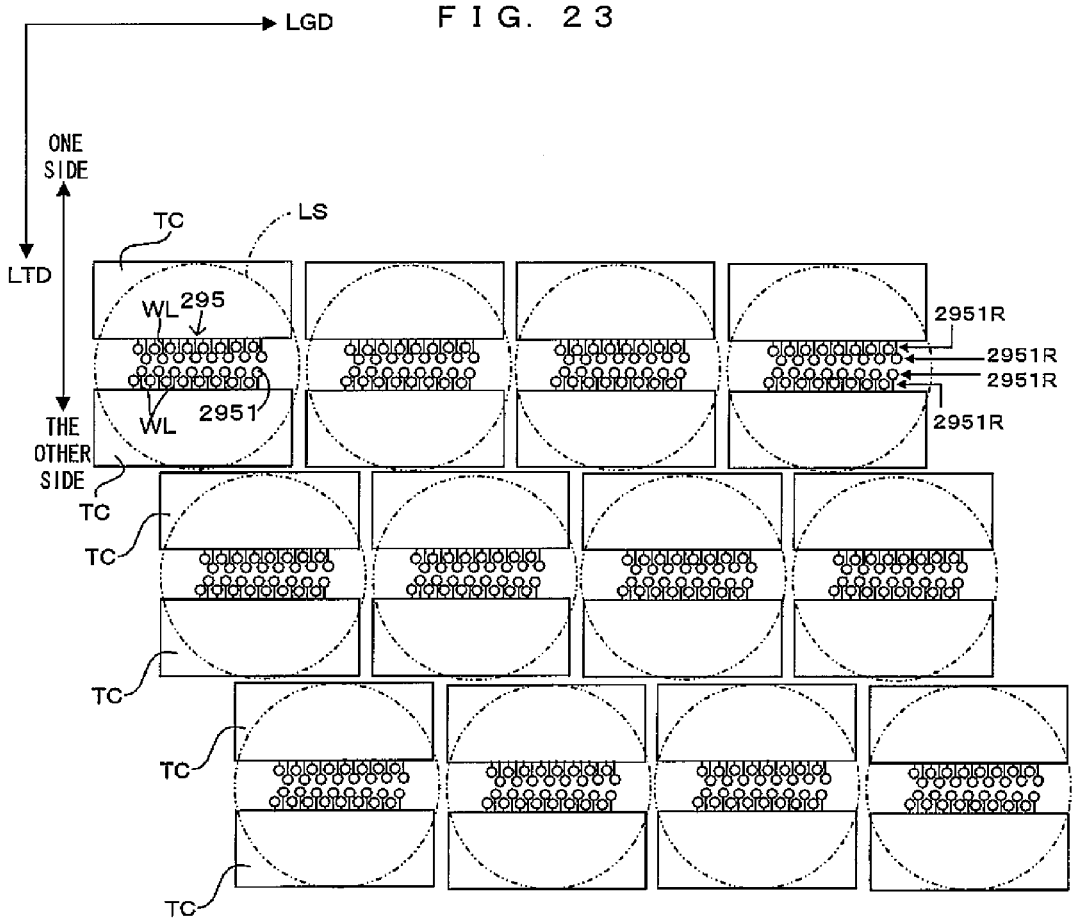
FIG. 23 is a diagram showing other structure of the light emitting element groups.

FIG. 23 is a diagram showing other structure of the light emitting element groups. As shown in FIG. 23, eight light emitting elements 2951 which are arranged in the longitudinal direction LGD constitute each light emitting element row 2951R. Four light emitting element rows 2951R which are arranged in the width direction constitute each light emitting element group 295. In each light emitting element group 295, the light emitting element rows 2951R are shifted from each other such that the positions of the light emitting elements 2951 differ in the longitudinal direction LGD. In this embodiment shown in FIG. 23 as well, the TFT circuits TC are provided on the both sides of the light emitting element groups 295 in the width direction LTD. Hence, it is possible to lead the interconnection wires WL, which are connected with the light emitting elements 2951 of the light emitting element groups 295, out to the both sides in the width direction LTD, and therefore, to improve the freedom of installing the interconnection wires WL.

Further, although three light emitting element group rows 295R are arranged side by side in the width direction LTD in the embodiments described above, the number of the light emitting element group rows 295R is not limited to three.

Further, in the above embodiments, the description is made about the case where organic EL elements are used as the light emitting elements 2951. However, the structure of the light emitting elements 2951 is not limited to this. For example, LEDs (light emitting diodes) may be used instead.

An embodiment of an exposure head according to the invention, comprises: an imaging optical system; a first light emitting element that emits a light which is to be focused by the imaging optical system; a second light emitting element that emits a light which is to be focused by the imaging optical system; a first TFT circuit that is connected with the first light emitting element via an interconnection wire; and a second TFT circuit that is connected with the second light emitting element via an interconnection wire, wherein the first light emitting element and the second light emitting element are provided between the first TFT circuit and the second TFT circuit.

An embodiment of a method of controlling an exposure head according to the invention, comprises: an exposure step of exposing a surface-to-be-exposed by means of an exposure head which includes an imaging optical system, a first light emitting element that emits a light which is to be focused on the surface-to-be-exposed by the imaging optical system, a second light emitting element that emits a light which is to be focused on the surface-to-be-exposed by the imaging optical system, a first TFT circuit that is connected with the first light emitting element via an interconnection wire and a second TFT circuit that is connected with the second light emitting element via an interconnection wire, and in which the first light emitting element and the second light emitting element are provided between the first TFT circuit and the second TFT circuit.

An embodiment of an image forming apparatus according to the invention comprises: a latent image carrier; and an exposure head which includes an imaging optical system, a first light emitting element that emits a light which is to be focused on the latent image carrier by the imaging optical system, a second light emitting element that emits a light which is to be focused on the latent image carrier by the imaging optical system, a first TFT circuit that is connected with the first light emitting element via an interconnection wire and a second TFT circuit that is connected with the second light emitting element via an interconnection wire, and in which the first light emitting element and the second light emitting element are provided between the first TFT circuit and the second TFT circuit.

In the embodiments structured as above (the exposure head, the method of controlling the exposure head, and the image forming apparatus), the first TFT circuit which is connected to the first light emitting element via the interconnection wire and the second TFT circuit which is connected to the second light emitting element via the interconnection wire are provided. The first light emitting element and the second light emitting element are provided between the first TFT circuit and the second TFT circuit. Hence, it is possible to lead the interconnection wires out to the both sides of the first light emitting element and the second light emitting element and to improve the freedom of installing the interconnection wires.

The first light emitting element, the second light emitting element, the first TFT circuit and the second TFT circuit may be provided on a first surface of the substrate. Further, it may be structured that a light from the first light emitting element and a light from the second light emitting element impinge upon the imaging optical system after passing through the substrate from the first surface to a second surface which is different from the first surface.

By the way, the exposure head may comprise a detector which detects a light from the first light emitting element and a light from the second light emitting element. In this case, the following effect can be obtained when the detector is provided on the substrate. That is, of light emitted from the first light emitting element and the second light emitting element, the detector can detect a light which is reflected inside the substrate. In addition, since the first and the second TFT circuits are provided on the substrate in the embodiments, the first and the second TFT circuits reflect light emitted from the first and the second light emitting elements. Hence, it is possible for the detector to detect larger amount of light and to improve the accuracy of the result of detection.

More than one such detectors may be provided. This makes it possible to detect even greater amount of light and to improve the accuracy of the result of detection.

An optical sensor which detects a light with a light receiving surface thereof may be used as the detector. In this case, the light receiving surface may be bonded to the substrate by an optical adhesive. Where such a structure is used, the optical adhesive erases the interface between the substrate and the light receiving surface, thereby suppressing unwanted reflection of light at the boundary between the substrate and the light receiving surface. As a result, the amount of light which impinges upon the light receiving surface is increased, which makes it possible to improve the accuracy of the result of detection.

It may be structured that the first TFT circuit drives the first light emitting element in accordance with the result of detection yielded by the detector and the second TFT circuit drives the second light emitting element in accordance with the result of detection yielded by the detector. With such a structure, it is possible to drive and make the light emitting elements emit appropriate amount of light and to realize a favorable exposure operation.

It is particularly preferable to structure that the light emitting elements are driven in accordance with the result of detection yielded by the detector in the case where the first light emitting element and the second light emitting element of the exposure head are organic EL elements. That is, since organic EL elements have a relatively short lifetime, when there is a frequency variation between the organic EL elements, the amount of emitted light may also vary between the organic EL elements. It is therefore preferable to apply the embodiment which proposes using the detector to a structure which uses organic EL elements so that the light emitting elements are driven to emit appropriate amount of light.

Further, it may be structured that a light shielding member which is provided with a light guide hole through which is bored from the first and the second light emitting elements toward the imaging optical system. With such a structure, the light shielding member suppresses incidence of ghost light upon the imaging optical system, thereby attaining favorable exposure.

Further, the method of controlling the exposure head described above may comprise a detection step of detecting the amount of light from the first light emitting element and light from the second light emitting element, and at the exposure step, the first light emitting element and the second light emitting element may be driven in accordance with the result of detection performed at the detection step. Such a structure makes it possible to drive and make the light emitting elements emit appropriate amount of light, and to realize a favorable exposure operation.

An embodiment of a line head according to another aspect of the invention comprises a head substrate, a detector, a TFT circuit and an interconnection wire. The head substrate has a one surface on which plural light emitting element groups each of which is a group of plural light emitting elements are provided and is structured to transmit light emitted from the light emitting elements from the one surface thereof toward other surface thereof. The detector is provided on the head substrate and detects light emitted from the light emitting elements. A light emitting element row which is formed by the plural light emitting elements which are arranged in a first direction are provided within the light emitting element group. The TFT circuit controls driving of the light emitting elements, is provided on the one surface of the head substrate and is located on both sides of the light emitting element group in a second direction which is orthogonal to or approximately orthogonal to the first direction. The interconnection wire connects the light emitting elements with the TFT circuit and is provided on the one surface of the head substrate.

An embodiment of an image forming apparatus according to another aspect of the invention comprises a line head that includes a head substrate, a detector, a TFT circuit and a interconnection wire, and a latent imaged carrier that is exposed by the line head. The head substrate has a one surface on which plural light emitting element groups each of which is a group of plural light emitting elements are provided and is structured to transmit light emitted from the light emitting elements from the one surface thereof toward other surface thereof. The detector is provided on the head substrate and detects light emitted from the light emitting elements. A light emitting element row which is formed by the plural light emitting elements which are arranged in a first direction are provided within the light emitting element group. The TFT circuit controls driving of the light emitting elements, is provided on the one surface of the head substrate and is located on both sides of the light emitting element group in a second direction which is orthogonal to or approximately orthogonal to the first direction. The interconnection wire connects the light emitting elements with the TFT circuit and is provided on the one surface of the head substrate.

In the embodiment (the line head, the image forming apparatus) thus structured, the TFT circuit is located on both sides of the light emitting element group in the second direction. This makes it possible to lead the interconnection wire, which is connected with the respective light emitting elements of the light emitting element groups, out to the both sides in the second direction, and therefore, to improve the freedom of installing the interconnection wire.

Further, in the embodiment, the detector which detects light emitted from the light emitting elements is provided on the head substrate. The detector is mainly provided in order to control the amount of light emitted from the respective light emitting elements. In other words, the TFT circuit controls driving of the light emitting elements in accordance with the result of detection which the detector yields for example, thereby achieving highly accurate control of driving of light emission. By the way, from a viewpoint of achieving such highly accurate control of driving of light emission, it is desirable that the amount of light incident upon the detector is as large as possible. With respect to this, the TFT circuit is provided on the one surface of the head substrate according to the embodiment. Since the TFT circuit functions as a reflection film which reflects light, the amount of light impinging upon the detector can be increased. Hence, the embodiment is capable of performing highly accurate control of driving of light emission, which is preferable.

Further, the TFT circuit may be so structured to control driving of the light emitting elements in such a manner that the respective light emitting elements emit uniform amount of light. With such a structure, the amount of light emitted from the respective light emitting elements is uniform and excellent exposure is possible.

A plurality of such detectors as described above may be provided on the head substrate. This structure makes it possible to highly accurately detect the amount of light from the light emitting elements.

Further, the light emitting elements may be organic EL elements. In other words, since organic EL elements have a relatively short lifetime, any variation in terms of how frequently the organic EL elements emit light may lead also to variation of amounts of light emitted by the organic EL elements. It is therefore preferable to apply the embodiment which is provided with the detector to a structure which uses organic EL elements so that highly accurate control of driving of light emission is achieved.

The detector may be formed by an optical sensor which detects light on a light receiving surface thereof and the light receiving surface may be bonded to the head substrate by an optical adhesive. With such a structure, the optical adhesive erases the interface between the substrate and the light receiving surface, thereby suppressing unwanted reflection of light at the boundary between the head substrate and the light receiving surface. As a result, the amount of light which impinges upon the light receiving surface is increased and even more accurate control of driving of light emission becomes possible.

Further, the embodiment may comprise a lens array and a light shielding member. The lens array includes lenses which are opposed against the light emitting element group from the other surface of the head substrate and are provided for each light emitting element group. The light shielding member is disposed between the head substrate and the lens array, and is provided with a light guide hole for each light emitting element group which is perforated from the light emitting element group toward the lens. That is, in this structure comprising such a lens array, light beams emitted from the light emitting element group are focused by the lens corresponding to the light emitting element group, which achieves exposure operation. Hence, with respect to execution of the exposure operation in a favorable manner, it is desirable that each lens receives only those light beams emitted from the corresponding light emitting element group and incidence of other light beams (ghost light) upon this lens is suppressed as much as possible. In this regard, the structure above uses the light shielding member which is provided with the light guide hole for each light emitting element group which is perforated from the light emitting element group toward the lens. It is therefore possible to block ghost light with the light shielding member. As a result, incidence of ghost light upon the lens is suppressed and favorable exposure operation is possible.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An exposure head, comprising:

a first light emitting element row that aligns light emitting elements;

a second light emitting element row that aligns light emitting elements;

an imaging optical system that images lights emitted from the first and second light emitting element rows;

a first TFT circuit that is connected with the first light emitting element row via interconnection wires;

a second TFT circuit that is connected with the second light emitting element row via interconnection wires; and a light shielding member that is provided with a light guide hole through which a light from the first light emitting element row and a light from the second light emitting element row pass toward the imaging optical system, wherein the first TFT circuit is arranged inside the light guide hole and the second TFT circuit is arranged inside the light guide hole, wherein the first light emitting element row and the second light emitting element row are provided between the first TFT circuit and the second TFT circuit.

2. The exposure head of claim 1, comprising a substrate that includes a first surface on which the first light emitting element row, the second light emitting element row, the first TFT circuit and the second TFT circuit are provided.

3. The exposure head of claim 2, wherein the substrate is made of a light transmissive material, and a light from the first light emitting element row and a light from the second light emitting element row impinge upon the imaging optical system after passing through the substrate from the first surface to a second surface which is different from the first surface.

4. The exposure head of claim 2, comprising a detector which detects a light from the first light emitting element row and a light from the second light emitting element row.

5. The exposure head of claim 4, wherein the detector is provided on the substrate.

6. The exposure head of claim 4, wherein plural detectors are provided.

7. The exposure head of claim 4, wherein the detector includes an optical sensor that has a light receiving surface which receives a light from the first light emitting element row and a light from the second light emitting element row.

8. The exposure head of claim 7, wherein the light receiving surface is bonded to the substrate by an optical adhesive.

9. The exposure head of claim 4, wherein the first TFT circuit drives the first light emitting element row in accordance with a detection result by the detector, and the second TFT circuit drives the second light emitting element row in accordance with a detection result by the detector.

10. The exposure head of claim 9, wherein the light emitting element of the first light emitting element row and the light emitting element of the second light emitting element row are organic EL elements.

11. The exposure head of claim 1, wherein imaging optical systems are arranged in a zigzag alignment so that an imaging optical system row aligns the imaging optical systems and equal to or more than two imaging optical system rows are arranged.

12. An exposure head comprising:

a first light emitting element row that aligns light emitting elements;

a second light emitting element row that aligns light emitting elements;

an imaging optical system that images lights emitted from the first and second light emitting element rows;

a detector which detects a light from the first light emitting element row and a light from the second light emitting element row;

a light shielding member that is provided with a light guide hole through which the light from the first light emitting element row and the light from the second light emitting element row pass toward the imaging optical system;

a first TFT circuit that is connected with the first light emitting element row via interconnection wires;

a second TFT circuit that is connected with the second light emitting element row via interconnection wires;

a substrate that includes a first surface on which the first light emitting element row, the second light emitting element row, the first TFT circuit and the second TFT circuit are provided, wherein the first light emitting element row and the second light emitting element row are provided between the first TFT circuit and the second TFT circuit, and the light shielding member has a through hole bored from outside the light shielding member toward light guide holes, and the detector is located inside the through hole.

* * * * *